US006094764A

United States Patent [19]

Veloskey et al.

[11] Patent Number: 6,094,764

[45] Date of Patent: Aug. 1, 2000

[54] SUCTION POWERED POOL CLEANER

[75] Inventors: Thomas E. Veloskey, San Marcos; Christopher E. Hatch, San Diego; Kevin J. Braidic, Carlsbad; Mark D. Van Etten, Temecula, all of Calif.

[73] Assignee: Polaris Pool Systems, Inc., Vista, Calif.

[21] Appl. No.: 09/090,894

[22] Filed: Jun. 4, 1998

[51] Int. Cl.[7] ..... E04H 4/16

[52] U.S. Cl. ..... 15/1.7

[58] Field of Search ..... 15/1.7; 210/169

[56] References Cited

U.S. PATENT DOCUMENTS

| | | | |
|---|---|---|---|
| 3,229,315 | 1/1966 | Watson | 15/1.7 |
| 3,790,979 | 2/1974 | Foster | 15/1.7 |
| 3,803,658 | 4/1974 | Raubenheimer | 15/1.7 |
| 3,822,754 | 7/1974 | Heinkin et al. | 180/7.1 |
| 3,979,788 | 9/1976 | Strausak | 15/1.7 |
| 4,023,227 | 5/1977 | Chauvier | 15/1.7 |
| 4,133,068 | 1/1979 | Hofmann | 15/1.7 |
| 4,152,802 | 5/1979 | Chauvier | 15/1.7 |
| 4,156,948 | 6/1979 | Chauvier et al. | 15/1.7 |
| 4,208,752 | 6/1980 | Hofmann | 15/1.7 |
| 4,351,077 | 9/1982 | Hofmann | 15/1.7 |
| 4,434,519 | 3/1984 | Raubenheimer | 15/1.7 |
| 4,449,265 | 5/1984 | Hoy | 15/1.7 |
| 4,463,468 | 8/1984 | Chauvier | 15/1.7 |
| 4,521,933 | 6/1985 | Raubenheimer | 15/1.7 |
| 4,536,908 | 8/1985 | Raubenheimer | 15/1.7 |
| 4,558,479 | 12/1985 | Greskovics et al. | 15/1.7 |
| 4,560,418 | 12/1985 | Raubenheimer | 15/1.7 X |
| 4,589,986 | 5/1986 | Greskovics et al. | 210/483 |
| 4,642,833 | 2/1987 | Stolz et al. | 15/1.7 |
| 4,643,217 | 2/1987 | Frentzel | 137/112 |
| 4,656,683 | 4/1987 | Raubenheimer | 15/1.7 |
| 4,729,406 | 3/1988 | Frentzel | 137/624.14 |
| 4,734,954 | 4/1988 | Greskovics et al. | 15/1.7 |
| 4,742,593 | 5/1988 | Kallenbach | 15/1.7 |
| 4,761,848 | 8/1988 | Hofmann | 15/1.7 |
| 4,766,931 | 8/1988 | Chauvier et al. | 137/624.14 |
| 4,769,867 | 9/1988 | Stolz | 15/1.7 |
| 4,789,364 | 12/1988 | Chauvier et al. | 440/5 |
| 4,790,344 | 12/1988 | Chauvier et al. | 137/112 |
| 4,807,318 | 2/1989 | Kallenbach | 15/1.7 |
| 4,849,024 | 7/1989 | Supra | 134/21 |
| 4,920,599 | 5/1990 | Rief | 15/1.7 |
| 4,939,806 | 7/1990 | Supra | 15/1.7 |
| 5,001,800 | 3/1991 | Parenti et al. | 15/1.7 |
| 5,014,382 | 5/1991 | Kallenbach | 15/1.7 |
| 5,033,504 | 7/1991 | Kallenbach | 137/493.1 |
| 5,105,496 | 4/1992 | Gray, Jr. et al. | 15/1.7 |
| 5,172,445 | 12/1992 | Chandler | 15/1.7 |
| 5,197,158 | 3/1993 | Moini | 15/1.7 |
| 5,259,082 | 11/1993 | Sebor | 15/1.7 |

(List continued on next page.)

FOREIGN PATENT DOCUMENTS

| | | | |
|---|---|---|---|
| 2520420 | 7/1983 | France | 15/1.7 |
| 2612043 | 9/1977 | Germany | 15/1.7 |
| 2181339 | 4/1987 | United Kingdom | 210/169 |

*Primary Examiner*—Mark Spisich
*Attorney, Agent, or Firm*—Kelly Bauersfeld Lowry & Kelley, LLP

[57] ABSTRACT

A pool cleaner is provided of the type powered by a suction or vacuum source, such as by connecting the pool cleaner via a vacuum hose or the like to the suction side of a conventional pool water filtration system. The pool cleaner comprises a compact housing carried on wheels for rolling movement along a submerged pool surface. A debris intake nozzle is formed at a lower end of the housing in close proximity with the pool surface, and communicates through a turbine chamber in the housing to the vacuum hose for water-borne vacuuming of debris from the pool surface. Water draw through the turbine chamber rotatably drives a turbine which in turn powers a drive train to rotatably drive the cleaner wheels together with a downforce fan for improved wheel traction. In addition, the drive train operates at least one timer cam for periodically actuating a reverse clutch assembly to drive at least one of the cleaner wheels in reverse for a brief time interval. The timer cam may also function to open a bypass door venting the turbine chamber to partially relieve the vacuum at the intake nozzle during the reverse drive mode.

59 Claims, 15 Drawing Sheets

U.S. PATENT DOCUMENTS

| | | | |
|---|---|---|---|
| 5,259,258 | 11/1993 | Sebor | 74/126 |
| 5,261,287 | 11/1993 | Sebor | 74/126 |
| 5,265,297 | 11/1993 | Gould et al. | 15/1.7 |
| 5,274,868 | 1/1994 | Sebor | 15/1.7 |
| 5,285,547 | 2/1994 | Sebor | 15/1.7 |
| 5,293,659 | 3/1994 | Rief et al. | 15/1.7 |
| 5,303,444 | 4/1994 | Sebor | 15/1.7 |
| 5,371,910 | 12/1994 | Sebor | 15/1.7 |
| 5,386,607 | 2/1995 | Sebor | 15/1.7 |
| 5,404,607 | 4/1995 | Sebor | 15/1.7 |
| 5,412,826 | 5/1995 | Raubenheimer | 15/1.7 |
| 5,450,645 | 9/1995 | Atkins | 15/1.7 |
| 5,546,982 | 8/1996 | Clark et al. | 137/557 |
| 5,634,229 | 6/1997 | Stoltz | 15/1.7 |

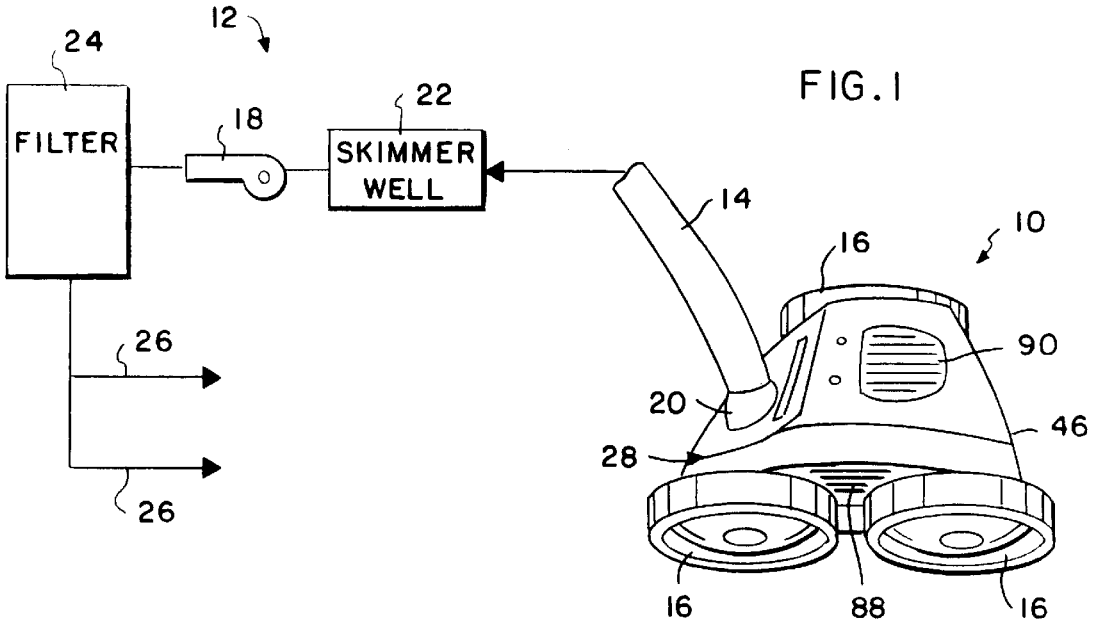
FIG. 1
FIG. 2
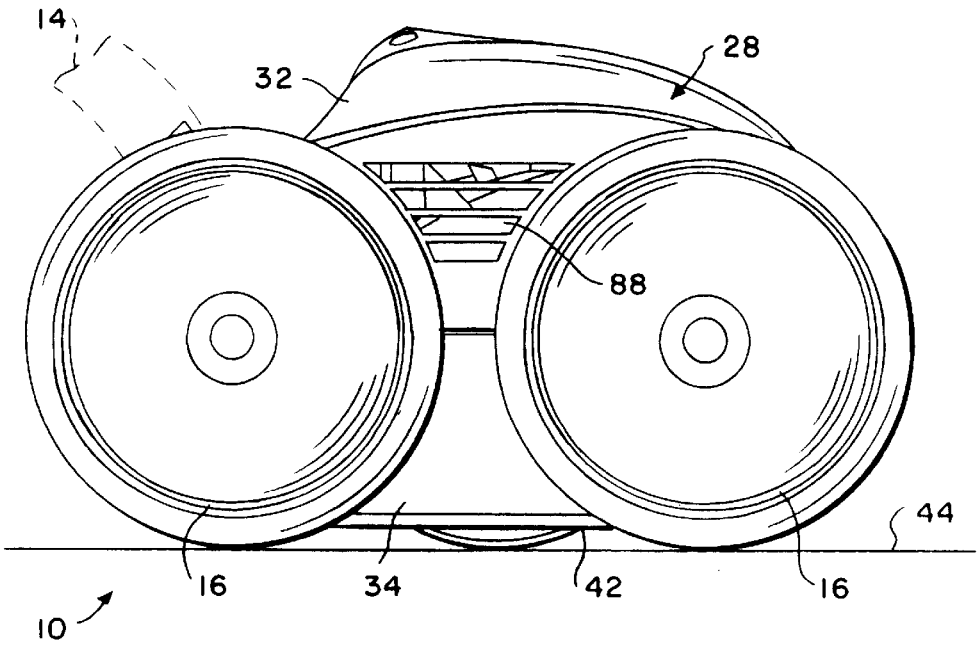

SUCTION POWERED POOL CLEANER

BACKGROUND OF THE INVENTION

This invention relates generally to automatic pool cleaning devices for travel over submerged surfaces of a swimming pool or the like to pick up and collect accumulated debris such as leaves, twigs, sand and silt. More particularly, this invention relates to an improved pool cleaner of the so-called suction or vacuum powered type, wherein the pool cleaner is designed for improved random travel over submerged pool surfaces, improved overall cleaning efficiency, and improved resistance to undesired cleaner entrapment in a corner or other irregular contoured surface of the pool.

Pool cleaner devices are generally well known in the art for use in maintaining residential and commercial swimming pools in a clean and attractive condition. In this regard, swimming pools conventionally include a water filtration system including a pump for drawing or suctioning water from the pool for circulation through a filter canister having filter media therein to remove and collect water-entrained debris such as leaves and twigs as well as fine particulate including sand and silt. From the filter canister, the water is recirculated to the pool via one or more return lines. Such filtration system is normally operated for several hours on a daily basis and serves, in combination with traditional chemical treatments such as chlorination or the like, to maintain the pool water in a clean and clear sanitary state. However, the water filtration system is ineffective to filter out debris which settles onto submerged floor and side wall surfaces of the swimming pool. In the past, settled debris has typically been removed by coupling a vacuum hose to the suction side of the pool water filtration system, such as by connecting the vacuum hose to a skimmer well located near the water surface at one side of the pool, and then manually moving a vacuum head coupled to the hose over the submerged pool surfaces to vacuum settled debris directly to the filter canister where it is collected and separated from the pool water. However, manual vacuuming of a swimming pool is a labor intensive task and is thus not typically performed by the pool owner or pool cleaning service personnel on a daily basis.

Automatic pool cleaner devices have been developed over the years for cleaning submerged pool surfaces, thereby substantially eliminating the need for labor intensive manual vacuuming. Such automatic pool cleaners typically comprise a relatively compact cleaner housing or head coupled to the pool water filtration system by a hose and including water-powered means for causing the cleaner to travel about within a swimming pool to dislodge and collect settled debris. In one form, the pool cleaner is connected to the return or pressure side of the filtration system for receiving positive pressure water which powers a turbine for rotatably driving cleaner wheels, and also functions by venturi action to draw settled debris into a filter bag. See, for example, U.S. Pat. Nos. 3,882,574; 4,558,479; 4,589,986; and 4,734,954. In another form, the pool cleaner is coupled to the suction side of the filtration system, whereby water is drawn through the pool cleaner to operate a drive mechanism for transporting the cleaner within the pool while vacuuming settled debris to the filter canister of the pool filtration system. See, for example, U.S. Pat. Nos. 3,803,658; 4,023,227; 4,133,068; 4,208,752; 4,643,217; 4,679,867; 4,729,406; 4,761,848; 5,105,496; 5,265,297; and 5,634,229.

While both positive pressure and suction side pool cleaners have proven to be generally effective in cleaning settled debris and the like from submerged pool surfaces, various customer preferences and installation considerations have been instrumental in causing an individual customer to choose one cleaner type over the other. More specifically, by comparison, positive pressure type cleaners are generally regarded as having superior random travel for improved overall coverage of submerged pool surfaces. Moreover, positive pressure cleaners normally exhibit better periodic back-up or reverse function to resist entrapment in a sharp corner or the like within a pool. However, such positive pressure cleaners typically require a booster pump and/or an additional water return line to be integrated into the filtration system, whereby the overall cost of installing a positive pressure cleaner particularly in an existing pool can be significant. By contrast, a suction side cleaner can be coupled by a vacuum hose directly into the existing skimmer well of a pool, for relatively simplified connection to the suction side of the filtration system in a pool that is not equipped with a pre-installed suction side cleaner flow line. Moreover, suction side cleaners are designed for operation without requiring an additional booster pump. Accordingly, suction side cleaners have tended to be somewhat less costly to install, in comparison with pressure side cleaners. However, the overall cleaning efficiency of a suction side cleaner, including random travel characteristics and the resistance to entrapment in a corner or the like, has not compared favorably with positive pressure cleaners.

There exists, therefore, a significant need for further improvements in pool cleaners of the suction powered type, particularly with respect to providing improved random travel and cleaning efficiency, and improved back-up capability to resist entrapment in a corner or the like, comparable to positive pressure side cleaners. The present invention fulfills these needs and provides further related advantages.

SUMMARY OF THE INVENTION

In accordance with the invention, an improved pool cleaner of the type powered by a suction or vacuum source is provided for vacuuming debris settled upon submerged floor and wall surfaces of a swimming pool or the like. The pool cleaner comprises a compact housing supported on wheels for rolling movement over submerged pool surfaces. The housing defines a debris intake nozzle positioned in close proximity with the pool surface, and coupled through a turbine chamber in the housing to the vacuum source, such as via a vacuum hose adapted for connection to the intake or suction side of a conventional pool water filtration system, for water-borne vacuuming of debris to the filtration system. Water flow through the turbine chamber rotatably drives a turbine coupled through a drive train for rotatably driving the cleaner wheels, and for additionally driving a downforce fan for improved wheel traction. The drive train also includes timer means for periodically actuating a reverse clutch assembly to drive at least one of the cleaner wheels in reverse for a short time interval.

In a preferred form of the invention, the turbine is positioned within the turbine chamber to be rotatably driven in a predetermined direction upon coupling of the turbine chamber to the vacuum source, for rotatably driving the drive train in a manner to drive the wheels for forward travel of the cleaner. The turbine comprises a multi-blade and preferably twin blade radial flow turbine, preferably having a backward curved geometry, supported within the turbine chamber for rotation on an axis disposed to extend generally in the direction of forward cleaner travel. The debris intake nozzle is oriented for generally circumferential inflow of water and entrained debris into the turbine chamber. The vacuum source is coupled to the turbine chamber via a suction port positioned for drawing water and entrained debris off an axial face of the turbine. With this configuration, debris residence time within the plane of the turbine is minimal, for reduced risk of debris entrapment within the turbine chamber.

In addition to rotatably driving the cleaner wheels, the turbine is coupled via the drive train to rotatably drive the downforce fan. This downforce fan, in the preferred form, is mounted within the cleaner housing near an upper end thereof in flow communication with one or more laterally open inlet vents and an upwardly open discharge vent formed in the cleaner housing. In operation, the downforce fan rotates in a direction to draw a substantial flow of water inwardly through the lateral inlet vents, and to discharge that water upwardly through the discharge vent. This results in a significant downwardly directed reaction force applied to the cleaner, tending to force the cleaner wheels against the underlying pool surface with improved traction.

In accordance with further important aspects of the invention, the drive train operates one or more timer cams associated with one or more reverse clutch assemblies for reversing the direction of rotation of one or more cleaner wheels. More particularly, in the preferred form, a pair of timer cams are associated respectively with a pair of reverse clutch assemblies for controlling the direction of rotation of the cleaner wheels at opposite sides of the cleaner housing. The timer cams periodically engage and actuate the reverse clutch assemblies for rotating the cleaner wheels in a reverse direction for a short time interval, for purposes of transporting the cleaner in reverse for a time and distance sufficient to prevent entrapment of the cleaner in a corner or other irregular shaped geometry within a swimming pool. The reverse clutch assemblies can be actuated together, or in sequence, or a combination of concurrent and sequential actuation, to achieve reverse and turning motion within the swimming pool. In addition, one of the timer cams may also engage and open a bypass door at one side of the turbine chamber, for substantially reducing or relieving the vacuum at the debris intake nozzle, and thereby facilitate enhanced reverse drive or turning movement when one of the wheels is operated in a reverse mode. The timer cam may also function to open the bypass door periodically during normal forward drive cleaner operation to assist in freeing the cleaner from obstacles such as a pool step.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view of an improved suction powered pool cleaner, shown in operative relation with a conventional pool water filtration system for a swimming pool or the like;

FIG. 2 is an enlarged right side elevational view of the pool cleaner;

DETAILED DESCRIPTION OF THE PREFERRED EMBODIMENT

Figure 3:
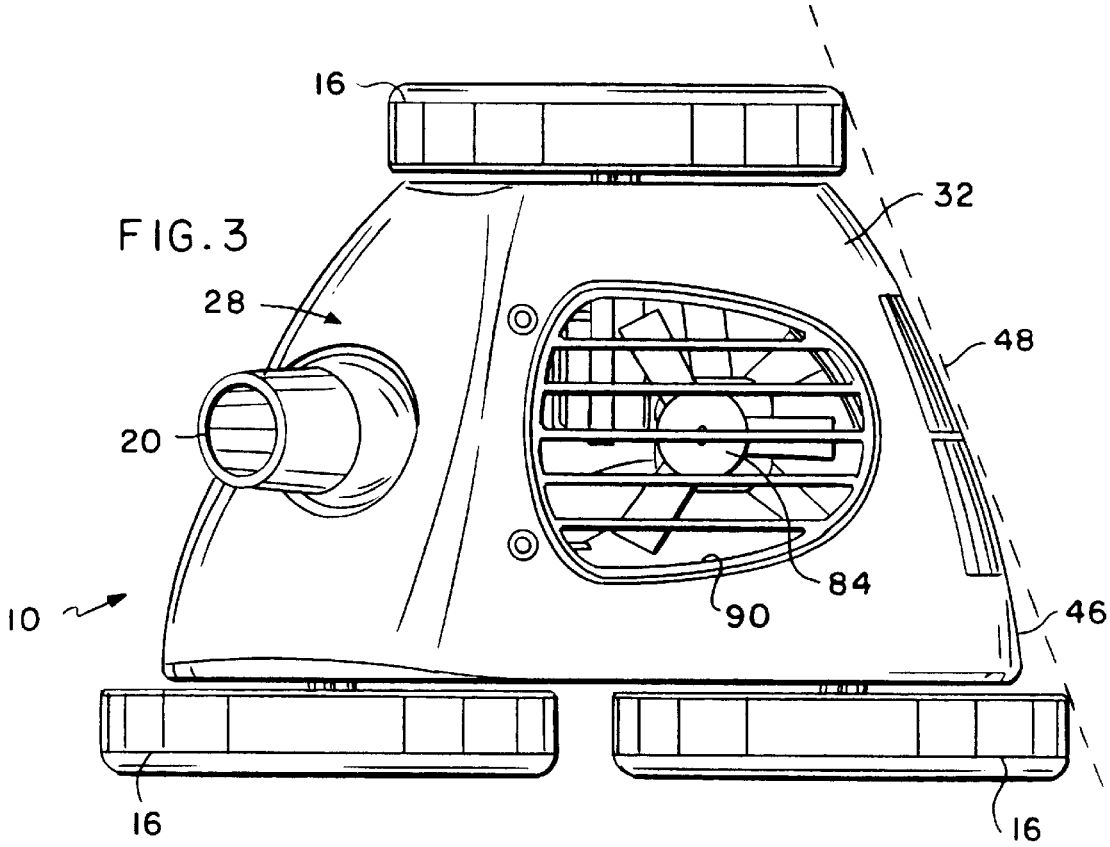
FIG. 3 is a top plan view of the pool cleaner.

As shown in the exemplary drawings, an improved pool cleaner referred to generally in FIGS. 1–6 by the reference numeral 10 is provided for vacuuming debris such as leaves and twigs as well as small particulate such as sand and silt settled onto submerged floor and wall surfaces of a swimming pool or the like. The pool cleaner 10 is powered by a suction or vacuum source, such as a conventional pool water filtration system 12 as depicted schematically in FIG. 1, by means of a vacuum hose 14. In operation, water is drawn by the filtration system 12 through the pool cleaner in a manner for water-borne vacuuming of debris settled onto submerged pool surfaces, and wherein this flow of water provides a power source for rotatably driving a plurality of cleaner wheels 16 in a manner achieving substantially random travel of the cleaner throughout the pool. The pool cleaner further includes improved traction means for enhanced drive traction between the cleaner wheels and the pool surface, together with improved back-up means for periodically driving the cleaner wheels in reverse to prevent undesired entrapment in corner or other irregular-shaped area within the pool.

The pool cleaner 10 of the present invention is shown in FIG. 1 coupled via the vacuum hose 14 to the suction side of a pump 18 forming part of the pool water filtration system 12. In this regard, the vacuum hose 14 is normally connected between a cylindrical suction fitting 20 on the pool cleaner and a skimmer well 22 mounted typically at one edge of the swimming pool at a location generally at the water's surface. As is well known in the art, the pump 18 draws pool water through the skimmer well 22 (as shown) for discharge flow through a filter canister 24 having a suitable filter media (not shown) therein for filtering and collecting water-entrained debris and particulate. From the filter canister 24, the water is recirculated to the swimming pool typically through a plurality of return lines 26. When the pool cleaner 10 is coupled by the vacuum hose 14 to the skimmer well 22, the pump 18 draws water under a vacuum or negative pressure through the cleaner, wherein this negative pressure water flow is utilized for powering the pool cleaner to travel about in a substantially random pattern within the pool while vacuuming debris settled onto submerged pool surfaces for collection within the filter canister 24. Alternately, it will be recognized and understood that some swimming pools may be equipped with a dedicated suction cleaner flow line (not shown) coupled directly from the pool wall to the filtration system 12, in which case the vacuum hose 14 would be coupled to said suction flow line.

FIGS. 2–7 show the pool cleaner 10 in greater detail, to comprise a relatively compact housing 28 supported by the plurality of wheels 16 for rolling displacement over submerged surfaces of the swimming pool. As shown in a preferred geometry, the cleaner housing 28 is constructed from upper and lower housing shells 32 and 34 (FIG. 7) which can be constructed from lightweight molded plastic and adapted to be interconnected by screws (not shown) or the like to define a hollow housing interior. Wheel ports 36 are cooperatively defined by the interconnected and interfitted housing shells 32, 34 to accommodate outward passage of wheel axles 38 mounted within the housing to a drive train subassembly 40, which will be further described in more detail. Each wheel axle 38 has an outboard end connected to and carrying one of the wheels 16. The wheels 16 support the cleaner housing 28 with a bottom wall 42 positioned in slightly spaced relation to an underlying wall or floor surface 44, as shown best in FIGS. 2 and 5. The suction fitting 20, which may conveniently include a swivel connector 45 (FIG. 7) extends upwardly and rearwardly from the drive train subassembly 40, through an open port 43 (FIG. 5) in the upper housing shell 32, for releasible connection to the vacuum hose 14.

Figure 6:
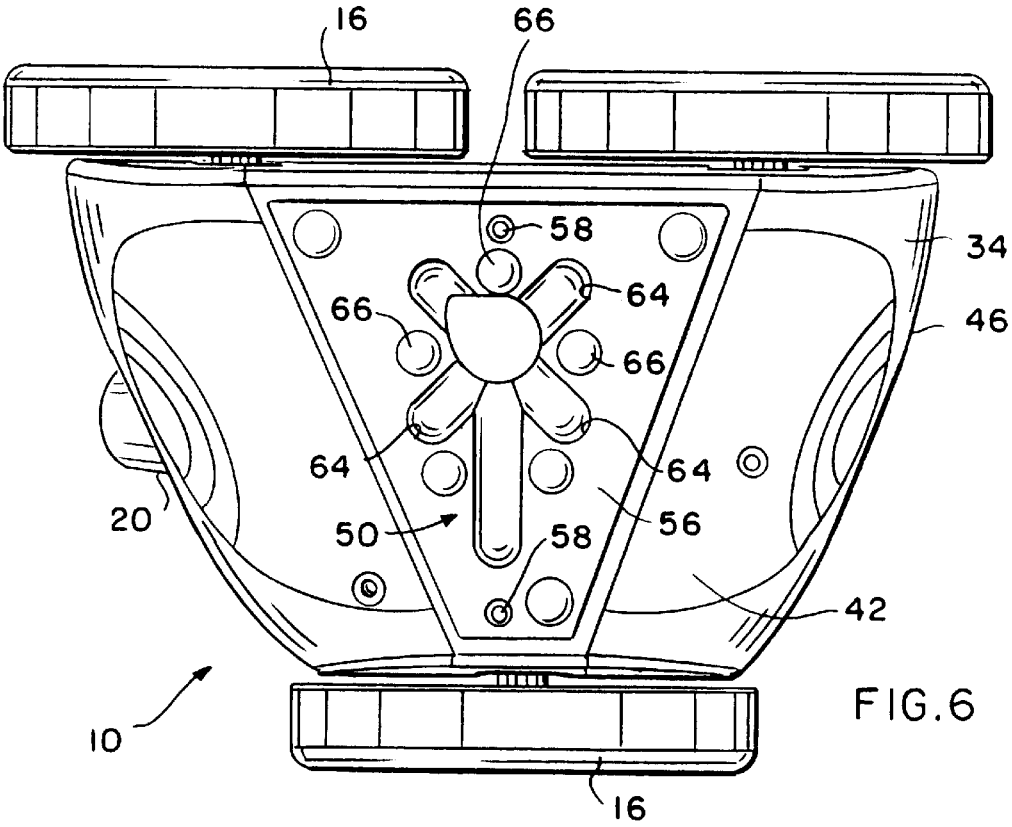
FIG. 6 is a bottom plan view of the pool cleaner.

The configuration of the cleaner housing 28 includes a front nose 46 set at an angle or skewed with respect to a longitudinal centerline and a normal forward direction of travel for the pool cleaner 10. More specifically, FIGS. 3 and 6 show the pool cleaner housing 28 with a somewhat triangular shape having a longer right side, in comparison with the left side of the cleaner housing, in combination with the angled front nose 46 which extends angularly rearwardly and laterally across the front of the cleaner housing from the right to left sides. A pair of the wheels 16 are mounted along the right side of the cleaner housing, whereas a single wheel 16 is positioned along the left side of the housing. These wheels 16 are desirably sized and positioned so that the leading edges of a wheel on each side of the cleaner housing 28 protrude slightly forward beyond the front nose 46 of the cleaner housing, whereby the wheels will contact a vertical wall surface 48 (FIG. 3) within a swimming pool and rollingly engage the wall surface enabling the cleaner to turn and/or climb without becoming trapped or stalled thereagainst. In this regard, the above described three wheeled geometry with angled front nose corresponds with so-called positive pressure pool cleaners marketed by Polaris Pool Systems, Inc. of San Marcos, Calif., under the trademark POLARIS VAC-SWEEP. See also, U.S. Pat. Nos. 3,882,574 and 4,734,954.

A debris inlet nozzle 50 is formed in the bottom wall 42 of the cleaner housing 28, and this inlet nozzle 50 is coupled to the suction source via the vacuum hose 14 so that water is drawn upwardly through the nozzle 50 for flow to the hose 14. The close proximity of the debris inlet nozzle 50 to the underlying pool surface 44 causes the vacuum-drawn water to pick up or entrain any debris such as leaves or twigs or small particulate settled onto the pool surface, for water-entrained flow through the hose 14 to the filter canister 24 of the filtration system 12. FIGS. 6, 10 and 12–14 show the inlet nozzle 50 opening upwardly into a turbine chamber 52 (FIGS. 12–14) formed in an otherwise substantially closed case 54 of the drive train subassembly 40, with the suction fitting 20 coupling the vacuum hose to the turbine chamber 52 at a rear side thereof.

Figure 12:
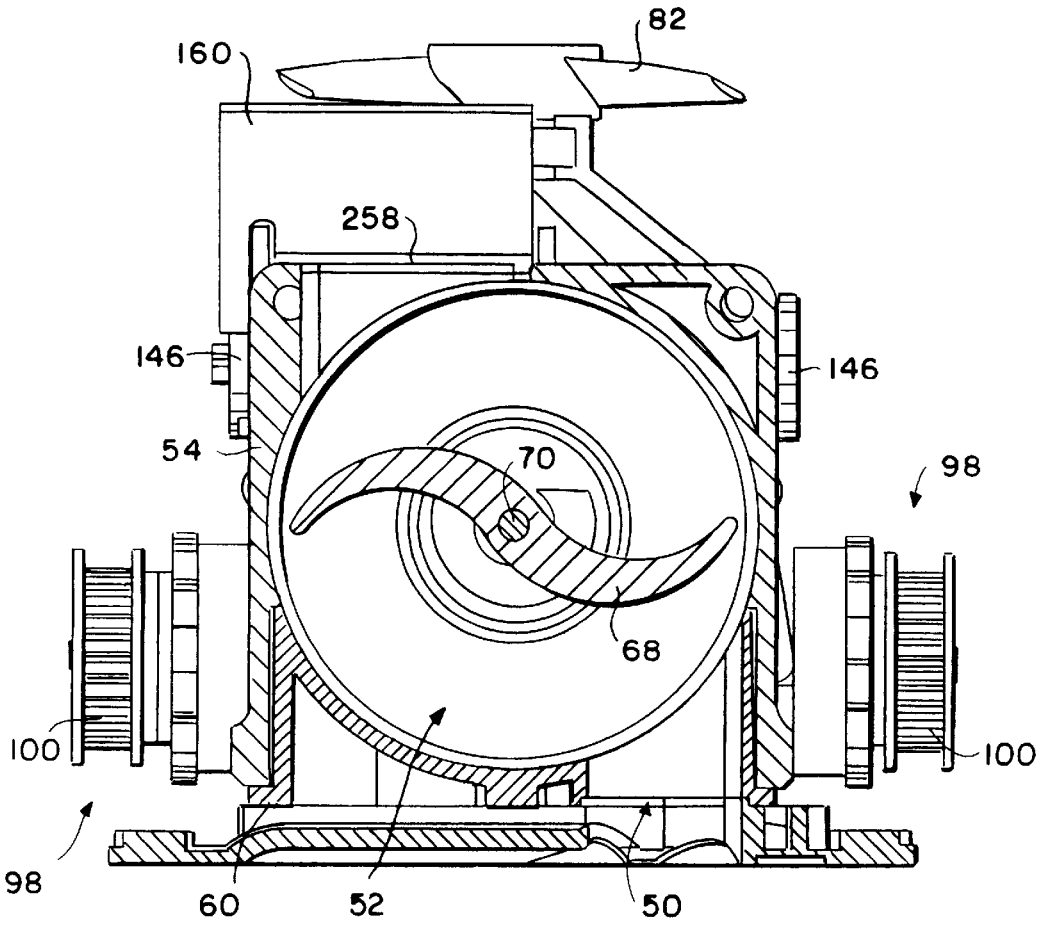
FIG. 12 is a transverse vertical sectional view taken generally on the line 12—12 of FIG. 11, but depicting a bypass vent door in an open position.
Figure 13:
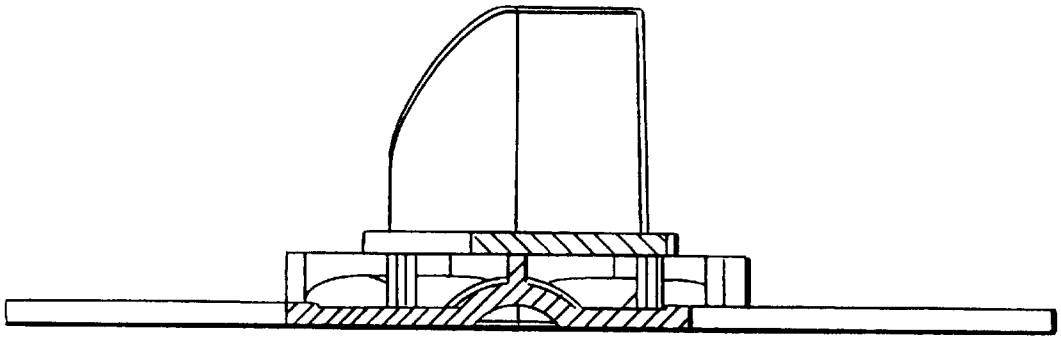
FIG. 13 is a fragmented vertical sectional view taken generally on the line 13—13 of FIG. 12.

In the preferred form, the debris inlet nozzle 50 is formed in an access plate 56 mounted removably onto and generally coplanar with the housing bottom wall 42 by means of screws 58 (FIG. 7) or the like. The nozzle 50 is formed in the access plate 56 at a location disposed off-center relative to a longitudinal center axis of the cleaner (FIGS. 6 and 12). A turbine inlet shroud 60 (FIGS. 7 and 12) defining a part-cylinder concave inboard surface 62 is formed as part of or otherwise connected by screws or the like to the turbine access plate 56, wherein this turbine inlet shroud 60 cooperates with the drive train case 54 to form a forward region of the turbine chamber 52 having a generally cylindrical shape disposed substantially centered on a longitudinal center axis of the cleaner. Importantly, the access plate 56 and the inlet shroud 60 carried thereby are removable quickly and easily from the exterior of the pool cleaner 1O, in the event that access to the turbine chamber 52 becomes necessary or desirable.

Figure 10:
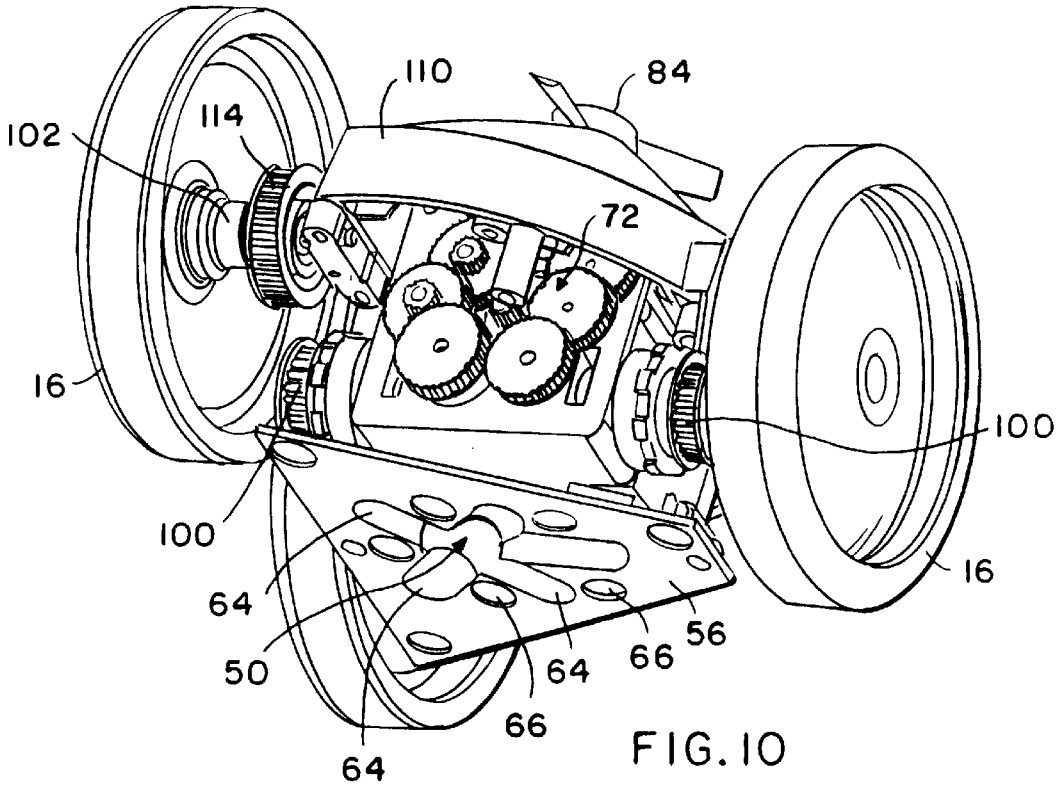
FIG. 10 is a rear perspective view of the drive train subassembly as depicted in FIG. 9, and showing the bottom and rear sides thereof.

As shown in FIGS. 6, 10 and 12, the outboard side of the access plate 56 is contoured to promote efficient vacuuming of water-entrained debris to the inlet nozzle 50 with minimal risk of clogging. To this end, the access plate includes a plurality of upwardly recessed flow channels 64 projecting radially outwardly from the inlet nozzle 50, to permit suction water flow from a relatively broad surface area of the adjacent pool surface 44 to the inlet nozzle. These flow channels 64 may be separated from each other by downwardly projecting spacer bumps 66 positioned close to the underlying pool surface. With this geometry, the vacuum effect from drawing water through the inlet nozzle 50 is distributed or projected over a substantial area of the pool surface, with the spacers 66 resisting suction inflow of relatively large objects. In accordance with one aspect of the design, the lowermost marginal edge of the inlet nozzle 50 intersects a lower or downwardly presented face of the access plate 56 at a relatively sharp and substantially perpendicular corner or edge, referred to in FIG. 12 by arrow 51, wherein this geometry has been found to provide a strong suction flow comparable to a conventionally smaller diameter flared contour nozzle of the type normally used in pool cleaners. This enables the inlet nozzle 50 in the present invention to have a larger diametric size to permit passage of larger debris without clogging, without sacrificing the desired high suction force.

In the event of clogging of the inlet nozzle 50 by large debris, a small auxiliary inlet port 55 (FIGS. 12 and 13) defined between the access plate 56 and the shroud 60 insures continuation of at least some water flow for continued cleaner operation. This auxiliary inlet port 55 opens into the interior of the cleaner housing 28 and functions to permit continued water flow albeit at a reduced flow rate through the turbine chamber 52 for continued drive operation of the various cleaner components, to be described in more detail. As a result, the cleaner will continue to operate, for example, to the next back-up or reverse cycle as will be described, at which time the clog may be purged without requiring manual intervention.

A water turbine 68 is rotatably carried within the turbine chamber 52 and is rotatably driven by the flow of water from the inlet nozzle 50 through the turbine chamber to the suction fitting 20. This water turbine 68, as shown in FIGS. 12 and 14, is thus driven by the vacuum drawn flow of water to provide a mechanical power source for driving the pool cleaner for travel throughout the pool with a substantially random travel pattern and with periodic reverse or back-up travel.

Figure 14:
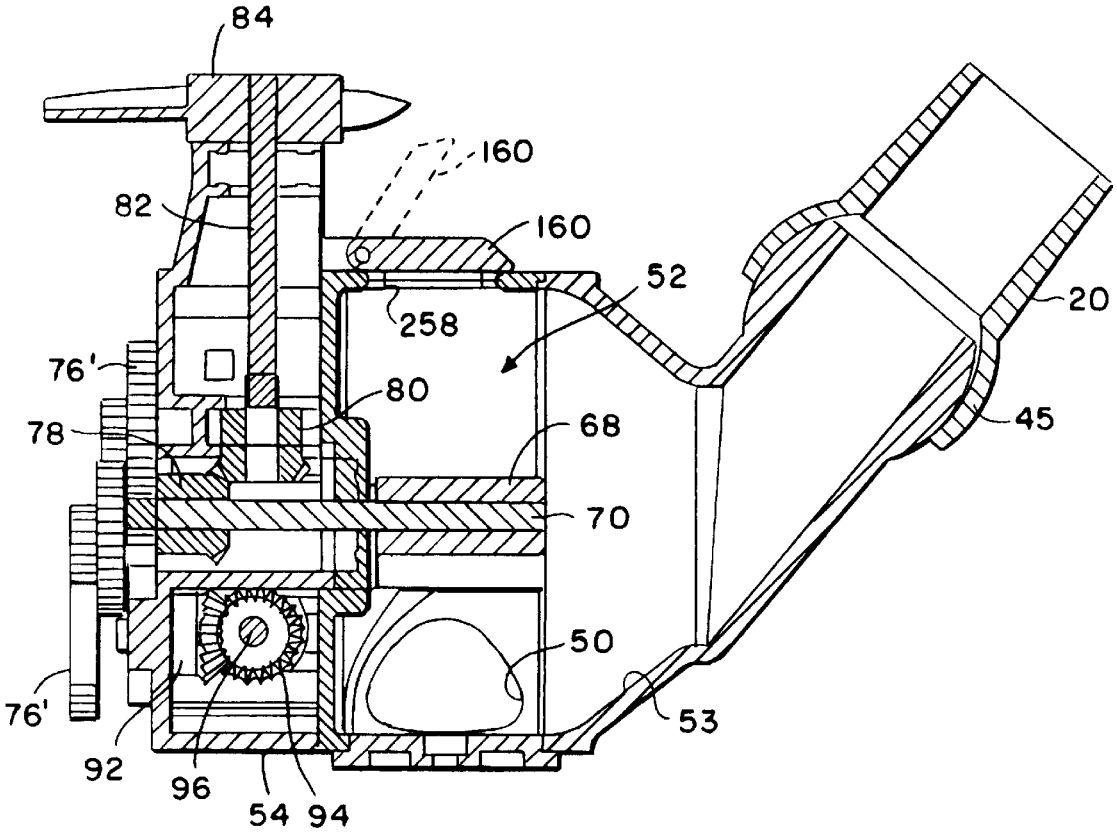
FIG. 14 is a longitudinal vertical sectional view taken generally on the line 14—14 of FIG. 11.

More specifically, and as depicted in FIGS. 12 and 14 in accordance with the preferred form of the invention, the water turbine 68 comprises a multibladed and preferably twin blade radial flow impeller. FIG. 12 illustrates the turbine 68 to include a pair of turbine blades of backward curved design, with a concave face of each blade facing in the direction of turbine rotation. The turbine 68 is carried on a drive shaft 70 for rotary motion within the turbine chamber 52. The drive shaft 70 is oriented to extend substantially in the direction of forward cleaner travel, and the turbine 68 is positioned in the forward cylindrical-shaped region of the turbine chamber so that the debris inlet nozzle 50 opens substantially circumferentially or approximately tangentially thereto (FIG. 12). In this orientation, water drawn through the turbine chamber 52 from the inlet nozzle 50 to the suction fitting 20 causes the turbine 68 to rotate. However, in accordance with one primary aspect of the invention, the vacuum drawn water flows substantially circumferentially into the turbine chamber 52 and then quickly turns to a generally axially rearward flow for passage to and through a plenum zone 53 (FIG. 14) on its way to the suction fitting 20. This plenum zone 53 is exposed to substantially the entire rear axial face of the turbine, so that debris entrained within the vacuum-drawn water flow encounters a very short residence time within the cylindrical forward region of the turbine chamber before turning axially rearward toward the suction fitting. In operation, the water-borne debris remains within the forward region of the chamber 52 for travel along an arcuate path corresponding with only about ninety degrees of turbine rotation. With such reduced residence of debris between the turbine blades, the opportunity for clogging upon ingestion of relatively large objects is significantly reduced.

Figure 11:
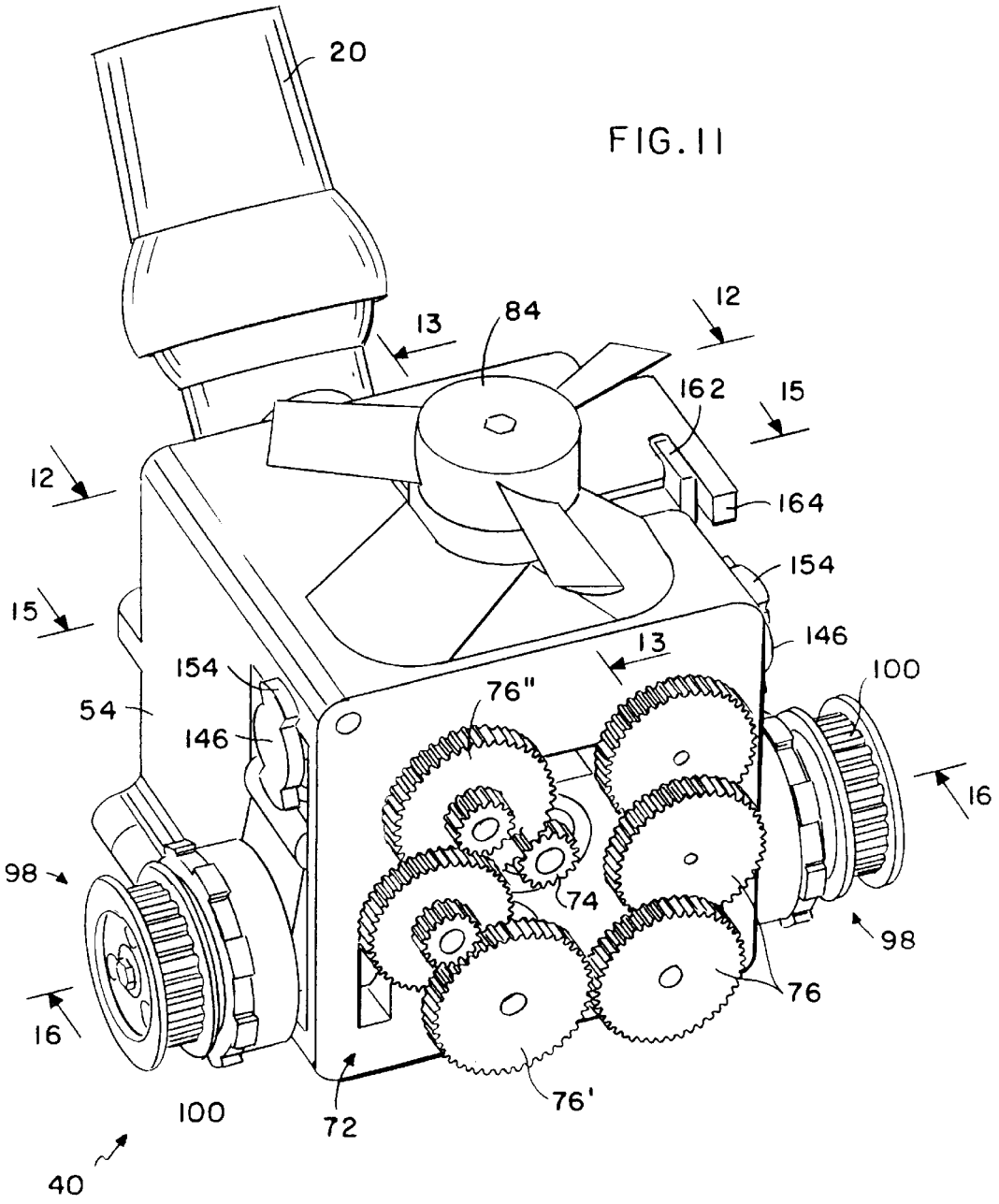
FIG. 11 is a front perspective view of a portion of the drive train subassembly shown in FIG. 8, with internal frame components removed.

The rotary motion of the turbine 68 is transmitted by the drive shaft 70 to a gear train 72 mounted on and within the case 54 of the drive train subassembly. In general terms, the drive shaft 70 rotates a primary drive gear 74 (FIGS. 7, 8 and 11) mounted on the case 54 in engagement with a series-engaged plurality of reduction gears referred to generally by the reference numeral 76. Selected ones of these reduction gears are connected in turn with additional gear components (FIGS. 14–16) mounted within the case 54, and as will be described in more detail, for mechanically driving the wheels 16 of the cleaner in a controlled manner. While FIGS. 7, 8 and 11 show some of the gear elements of the drive train 72 mounted in an exposed position at the front of the case 54, it will be appreciated that these gear elements may be encased within a protective cowling (not shown) to be mounted onto the case 54.

Figure 4:
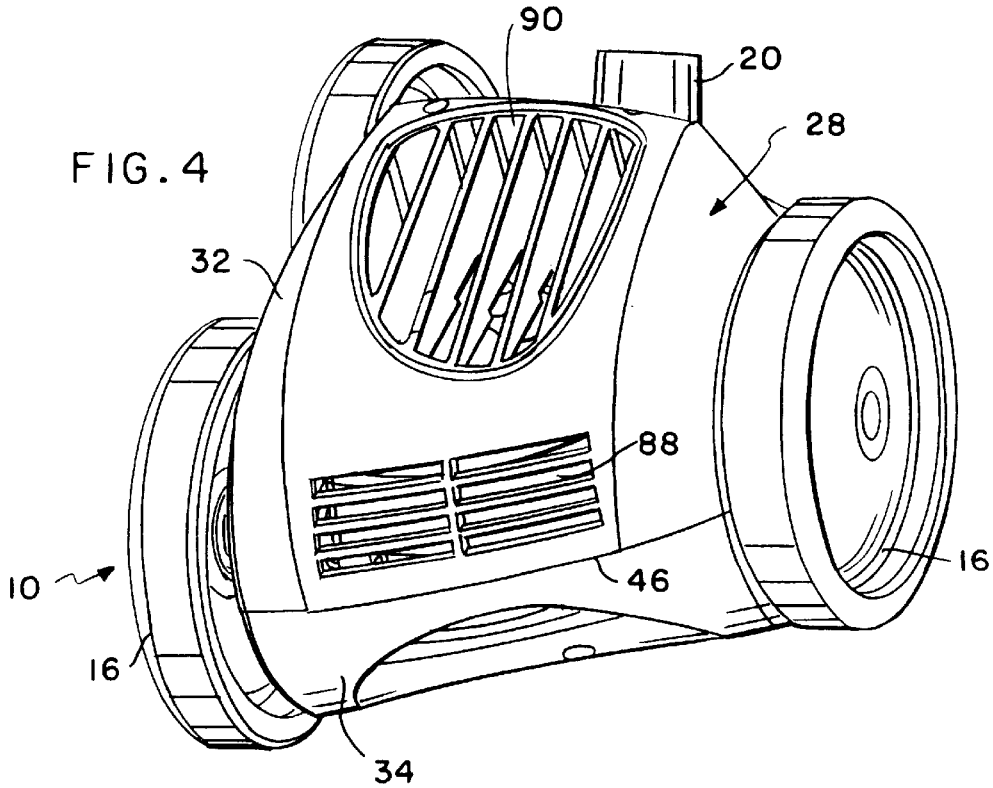
FIG. 4 is a perspective view of the pool cleaner showing the top, front and left sides thereof.
Figure 5:
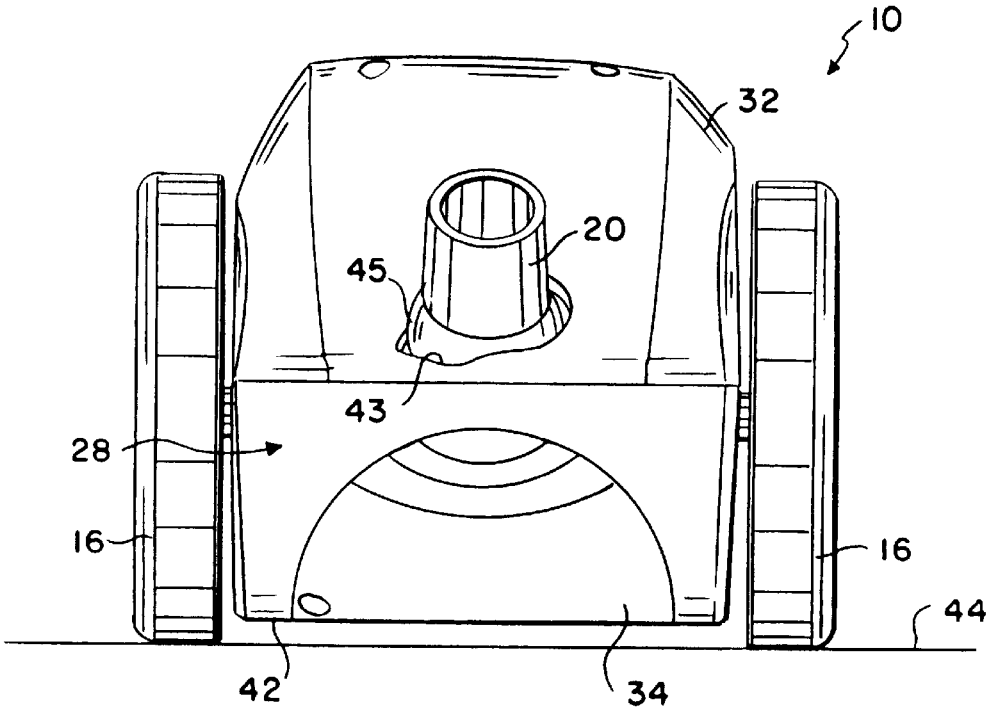
FIG. 5 is a rear elevational view of the pool cleaner.
Figure 15:
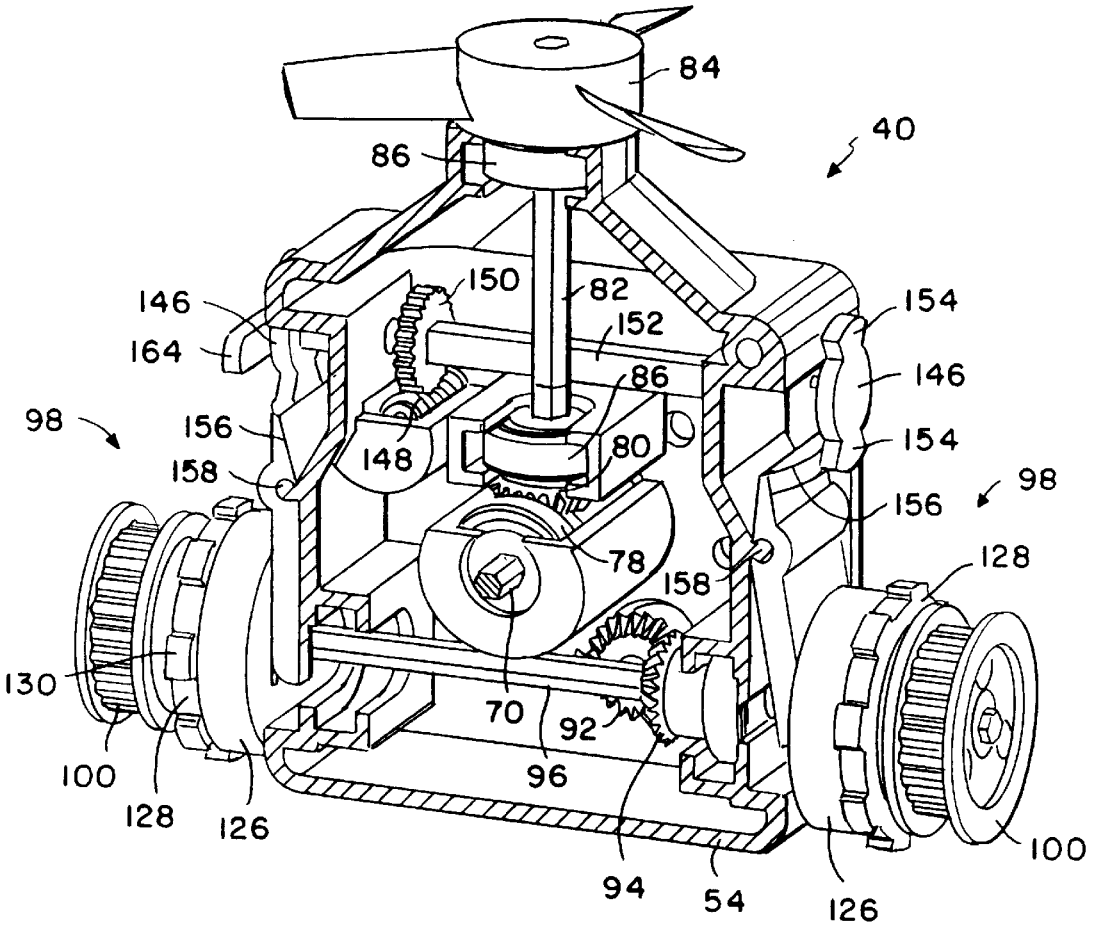
FIG. 15 is a perspective view of a portion of the drive train subassembly as depicted generally in FIG. 11, in transverse vertical section taken generally on the line 15—15 of FIG. 11, to reveal the assembly of internal drive train components.
Figure 16:
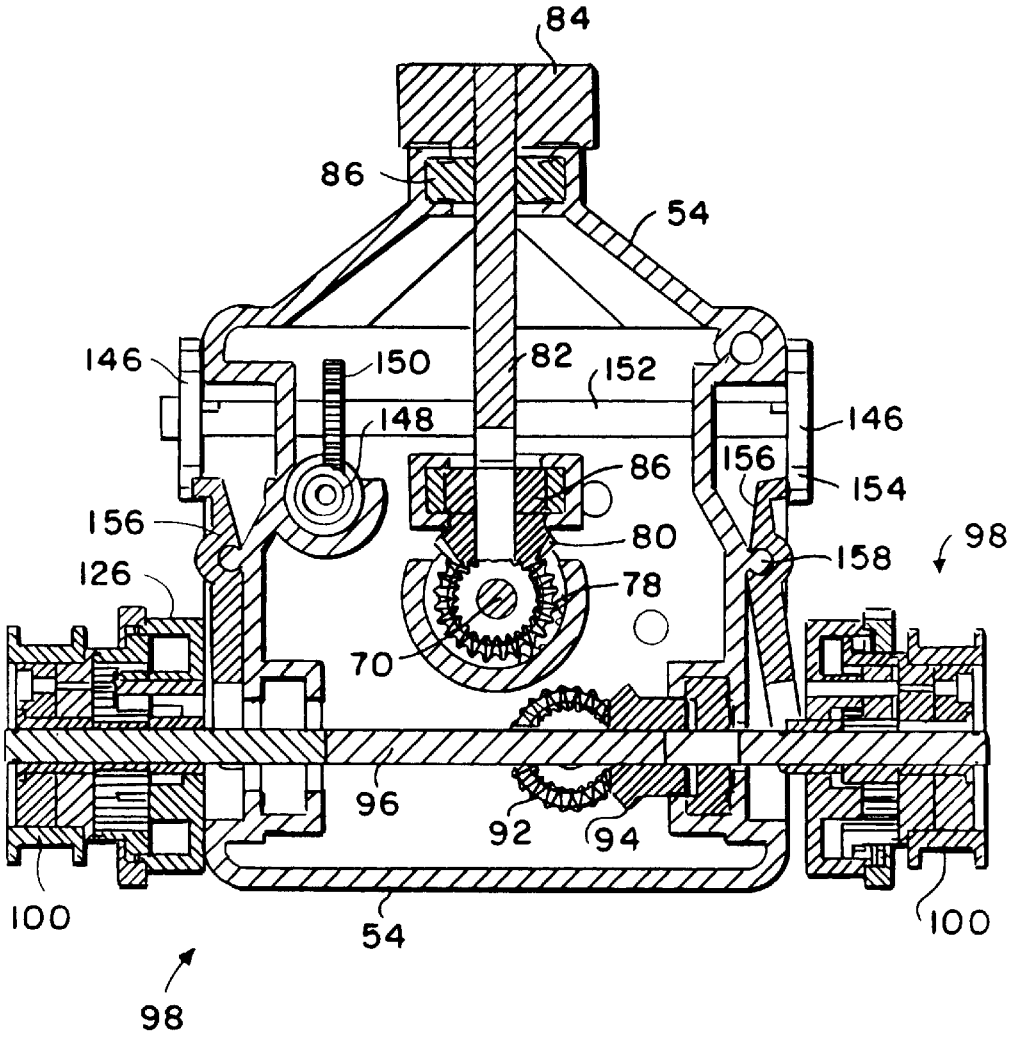
FIG. 16 is a transverse vertical sectional view taken generally on the line 16—16 of FIG. 11.

In addition, as shown in FIGS. 14–16, the drive shaft 70 has a noncircular cross sectional shape such as a hexagonal shape for rotatably driving a bevel gear 78 mounted thereon within the case 54. This bevel gear 78 is meshed in turn with a second bevel gear 80 to couple the rotary drive shaft motion through a right angle via a driven shaft 82 carrying a multibladed downforce propeller or fan 84 positioned above the case 54. Bearings 86 are conveniently provided to rotatably support of the driven shaft 82. In operation, the turbine 68 rotatably drives the downforce fan 84 is a direction to draw pool water laterally inwardly into the cleaner housing 28 through one or more laterally open intake vents 88 (FIGS. 2–4) formed in the upper housing shell 32, and to expel the water in an upward direction through an upwardly open discharge vent 90 (FIGS. 3–4). The upward water discharge from the cleaner results in a substantial downwardly directed reaction force which urges the cleaner toward the underlying pool surface 44 with improved traction between the wheels 16 and the pool surface. The downforce created by the downforce fan 84 enhances cleaner vacuuming efficiency by maintaining the cleaner in an orientation with the debris intake nozzle in close proximity to the adjacent pool surface, and also enhances the ability of the cleaner to transition through curved surfaces at the base of a pool side wall to facilitate climbing and cleaning pool side walls. In addition, the water flows created by the downforce fan 84 within the body of pool water effectively enhance the mixing and distribution of pool chemicals, and also stir up some fine silt and sediment so that it can be drawn through the filtration system 12 for removal.

As shown best in FIGS. 11 and 14–16, one of the reduction gears referred to by the reference numeral 76' is coupled back to and rotatably drives a first bevel gear 92 mounted within the case 54 of the drive train subassembly 40. This first bevel gear 92 is meshed in turn with a second bevel gear 94 carried on and rotatable with a transversely mounted wheel drive shaft 96. This wheel drive shaft 96 extends laterally outwardly from the case 54, with its outboard ends carrying a pair of reverse clutch assemblies 98 each including a drive sprocket 100. During normal forward-drive operation of the pool cleaner, the turbine 68 is coupled through these gear components for rotatably driving the wheel drive shaft 96 in a manner rotatably driving the sprockets 100 in a forward-drive direction. In this regard, during such forward-drive operation, the reverse clutch assemblies 98 are not activated.

Figure 7:
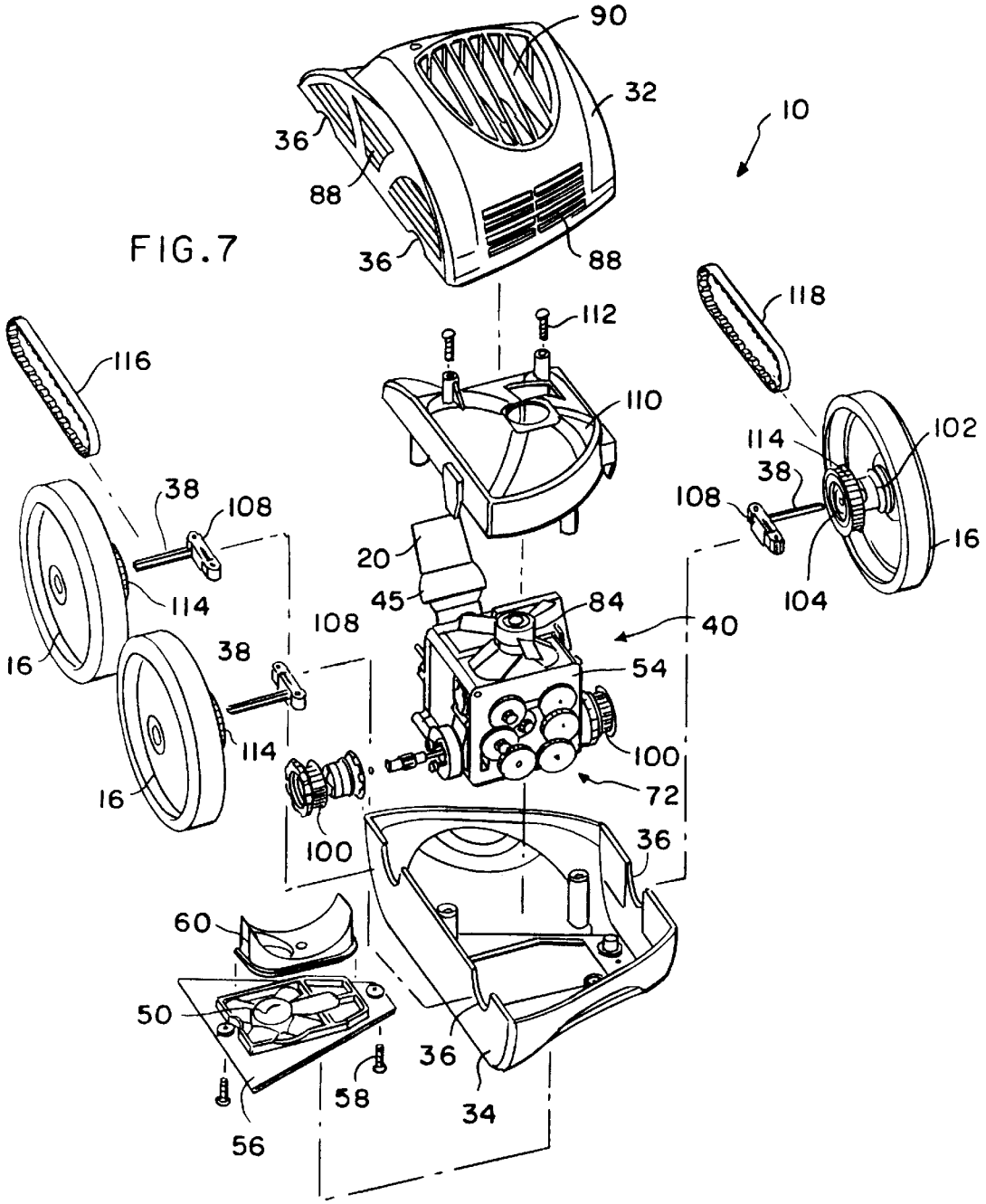
FIG. 7 is an exploded perspective view illustrating assembly of the pool cleaner.
Figure 8:
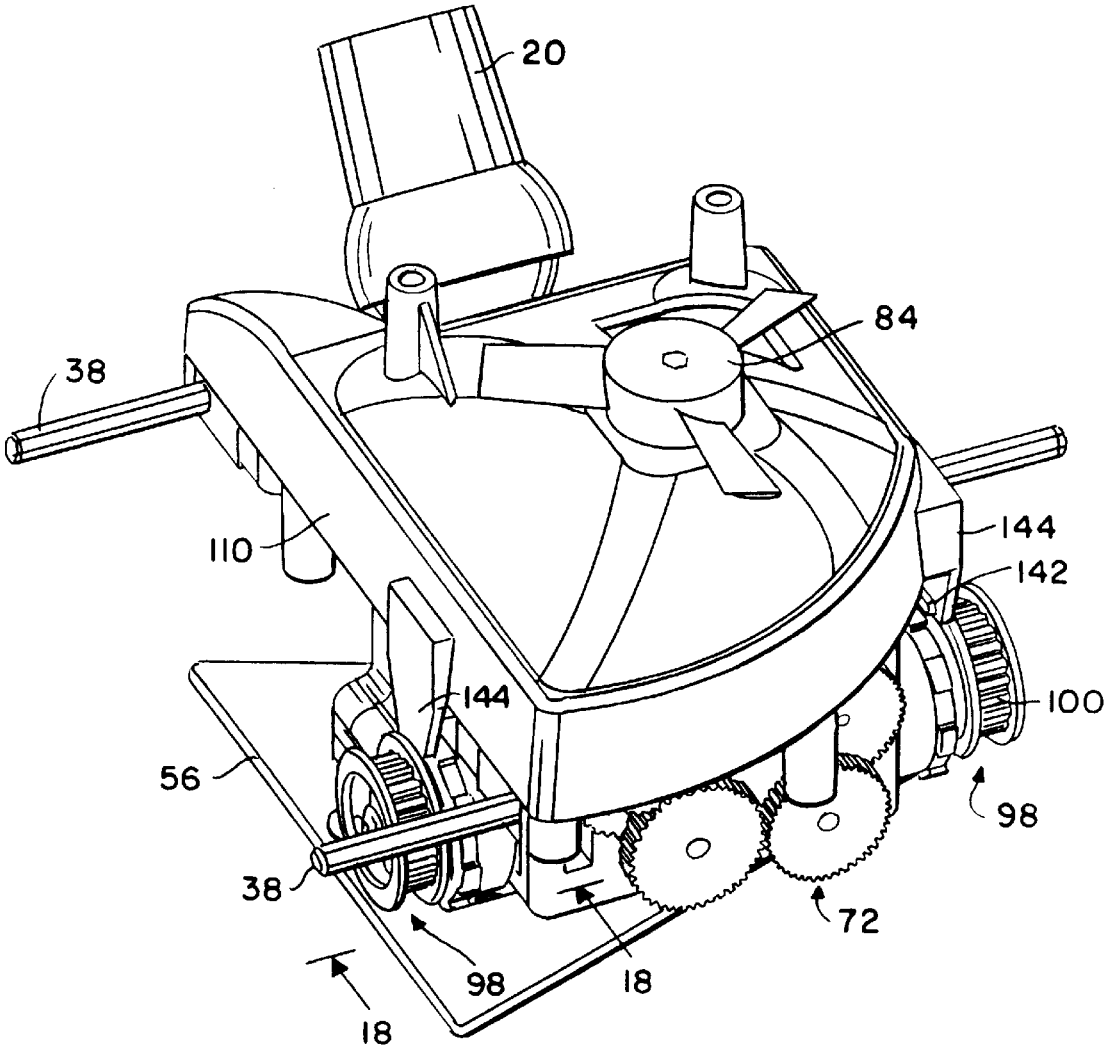
FIG. 8 is a front perspective view illustrating a drive train subassembly, shown prior to assembly with cleaner wheels.
Figure 9:
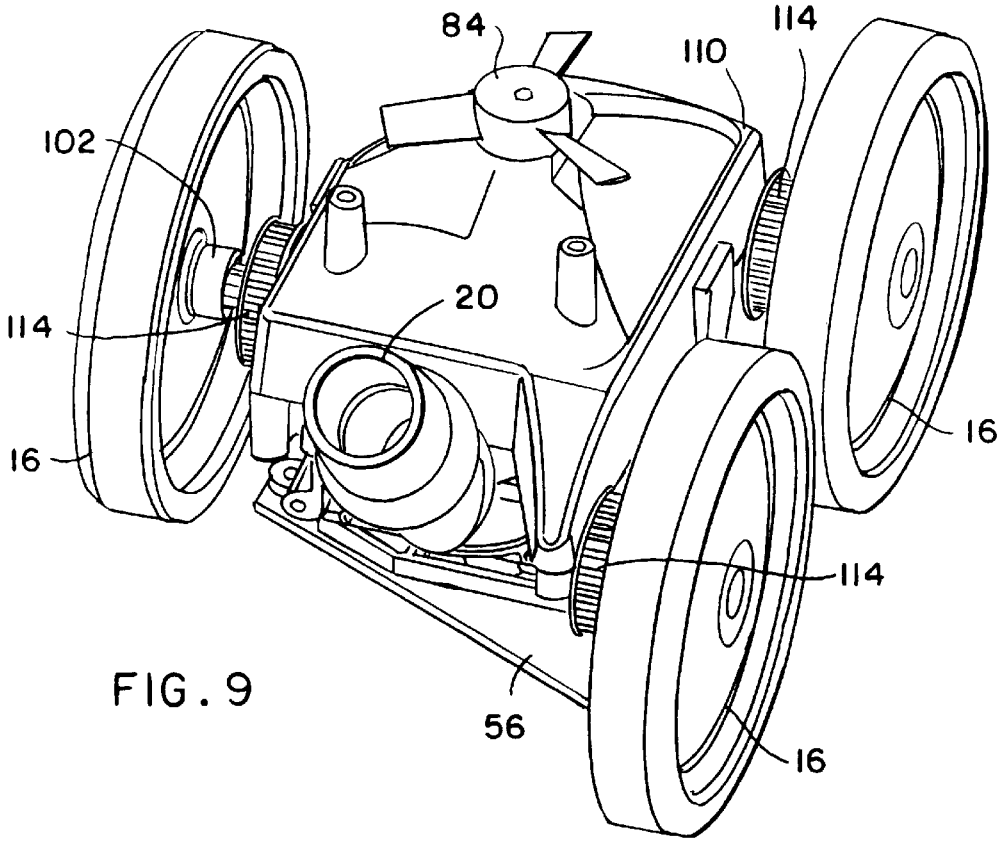
FIG. 9 is a rear perspective view of the drive train subassembly, depicting the top and rear sides thereof, and showing the cleaner wheels assembled thereto.

FIG. 7 shows each of the three cleaner wheels 16 to include a hub 102 having a bearing 104 adapted for connection to the axle 38 anchored by a bracket 108 which is attached by screws or the like (not shown) to an internal frame 110 of the pool cleaner. This frame 110 is designed for secure mounting onto the top of the drive train case 54 by means of screws 112 or the like, with the axles 38 rotatably supporting the wheels 16 from the internal frame. Importantly, each wheel hub 102 additionally includes a driven sprocket 114 which is positioned upon final assembly of the cleaner components generally coplanar with the drive sprocket 100 on the associated side of the drive train case 54. A pair of sprocket drive belts 116 and 118 are provided respectively on the right and left sides of the case 54 for coupling the driven sprockets 114 with the associated drive sprockets 100 to provide positive rotary drive to the cleaner wheels 16. More specifically, with reference to the preferred embodiment as viewed in FIG. 7, the drive belt 116 on the right side of the cleaner is reeved about the drive sprocket 100 and the two driven sprockets 114 on the two wheels 16 located on that side of the cleaner, whereas the other drive belt 118 on the left side of the cleaner is reeved about the drive sprocket 100 and the driven sprocket 114 on the single wheel 16 at that side of the cleaner.

When the reverse clutch assemblies 98 are not actuated, the rotary drive connection to the cleaner wheels 16 results in forward-drive transport of the pool cleaner within the swimming pool. The cleaner 10 progresses over submerged pool surfaces to vacuum debris through the intake nozzle 50 for collection ultimately within the filter canister 24 of the pool filtration system 12. As the cleaner moves along an inclined floor surface of the pool upon travel between deep and shallow ends, the three-wheeled geometry contributes to a substantially random turning pattern to provide a highly random path of travel which results in the cleaner traveling over substantially all surfaces of the pool in a relatively short period of operation. Moreover, as the cleaner approaches a curved transition region at the lower end of a substantially vertical pool side wall, the cleaner geometry again contributes to random turning patterns and random paths of travel which frequently include climbing the side wall to suction debris settled thereon.

Figure 17:
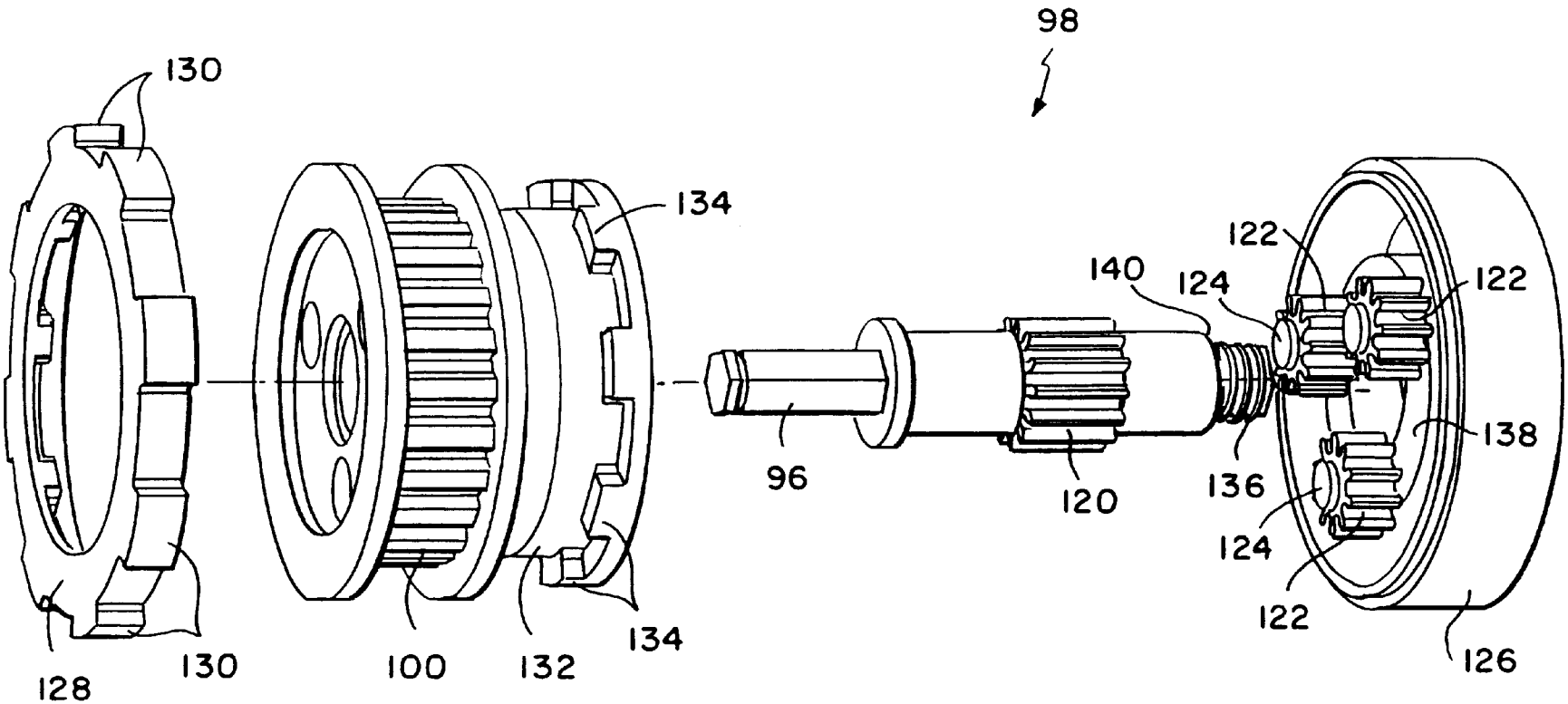
FIG. 17 is an exploded perspective view illustrating a reverse clutch assembly, depicting the components thereof from an outboard side.
Figure 18:
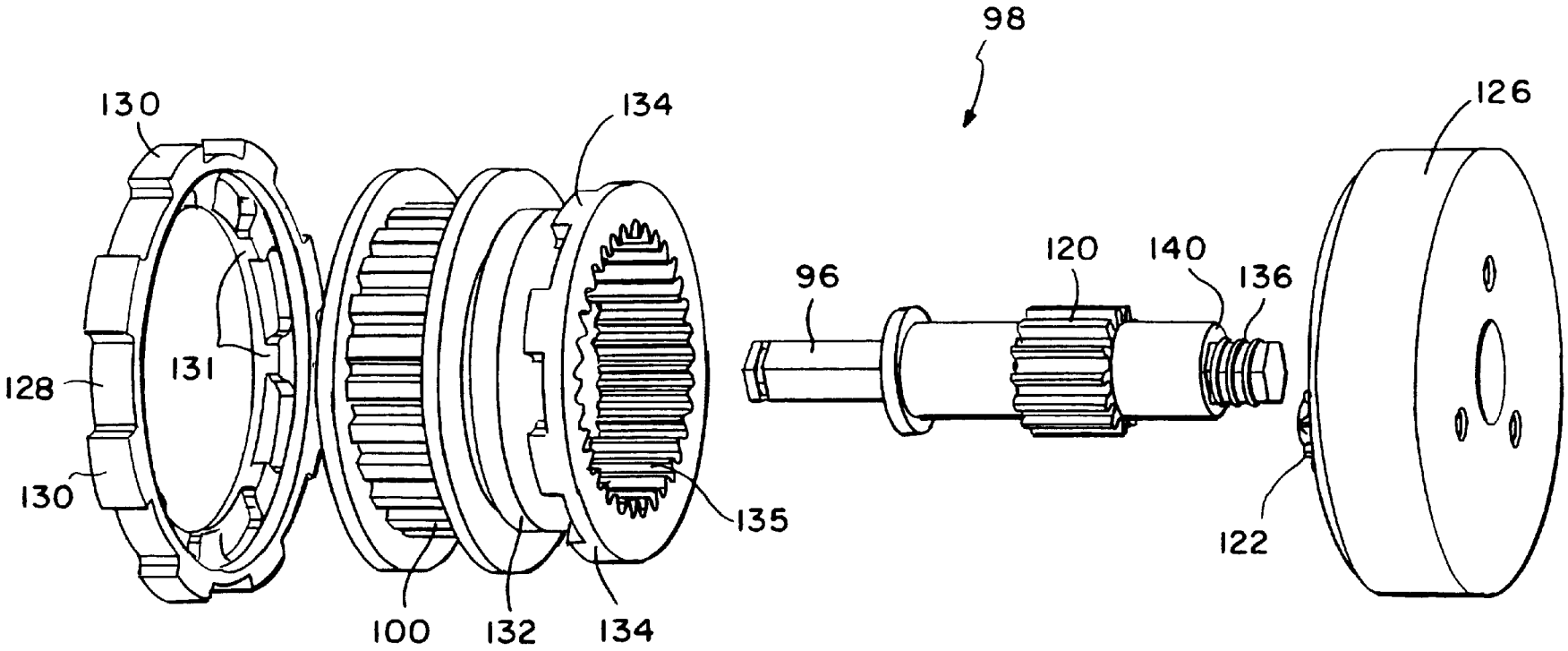
FIG. 18 is an exploded perspective view of the reverse clutch assembly shown in FIG. 17, but depicting the components thereof from an inboard side.
Figure 19:
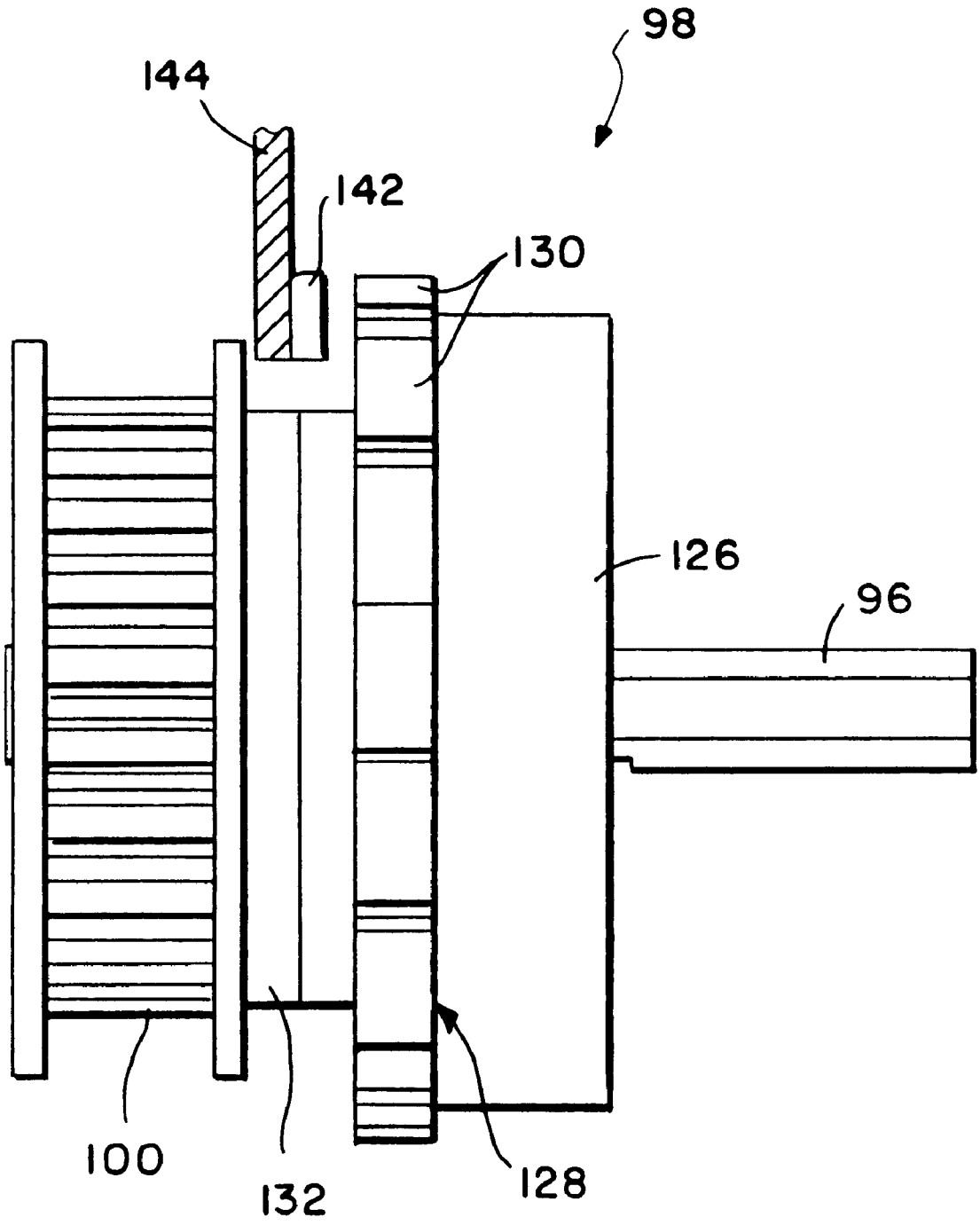
FIG. 19 is an enlarged fragmented front elevational view of a portion of the drive train subassembly, taken generally on the line 19—19 of FIG. 8, and illustrating operation of the reverse drive subassembly depicted in detail in FIGS. 17–18.

One of the reverse clutch assemblies 98 is shown in more detail in FIGS. 17–19. As shown, the clutch assembly 98 comprises a sun gear 120 mounted on the wheel drive shaft 96, wherein this sun gear 120 is meshed with a trio of planet gears 122 rotatably carried on individual spindles 124 protruding in an outboard direction from a planetary gear case 126. This gear case 126 assembled with a cog ring 128, as by snap fit connection therewith. The cog ring 128 includes a plurality of radially outwardly projecting external cog teeth 130 and a series of inner cog teeth 131. In the final assembled position, the cog ring 128 is disposed about a drive sleeve 132 formed at or otherwise connected to the associated drive sprocket 100 at an inboard face thereof. The drive sleeve 132 is rotatable with the drive sprocket 100 and includes a set of drive cogs 134 for releasibly engaging the inner cog teeth 131 on the cog ring 128 to provide a rotary drive connection therebetween. The drive sleeve 132 also defines an internal ring gear 135 (FIG. 18) meshed with the planet gears 122.

A spring 136 is carried about the drive shaft 96 and reacts between an outboard face 138 of the gear case 126 and a shoulder 140 on the drive shaft to urge or shift the gear case 126 normally in an inboard direction, for purposes of carrying the cog ring 128 in an inboard direction to mesh the inner cog teeth 131 with the drive cogs 134 coupled to the drive sprocket 100. Accordingly, in a normal condition of operation, the planetary gear case 126 is locked with the drive sleeve 132 and the drive sprocket 100 for rotation therewith in response to rotary motion of the drive shaft 96, to rotate the drive sprocket 100 in a direction for forward-drive motion of the cleaner wheels 16. During this forward-drive mode, the concurrent rotation of the gear case 126 and the drive sleeve 132 precludes relative rotation between the planet gears 122 and the ring gear 135.

A reverse drive mode is achieved by shifting the planetary gear case 126 in an outboard direction against the biasing force of the spring 136, to move the inner cog teeth 131 of the cog ring 128 out of meshed engagement with the drive cogs 134 on the drive sleeve 132. Such outboard shifting of the gear case 126 displaces the outer cog teeth 130 of the cog ring 128 into meshed engagement with a lock lug 142 formed on a flange 144 (FIGS. 8 and 19) of the internal frame 110. Alternately, this lug 142 may be on any other fixed component such as the drive train case 54. Accordingly, the planetary gear case 126 is physically separated from the drive sleeve 132 and locked against any rotation. As a result, the planet gears 122 are now free to rotate relative to the ring gear 135, whereby the planet gears 122 now rotatably drive the drive sleeve 132 via the ring gear in a reverse-drive direction. Thus, outboard shifting of the planetary gear case 126, as described, results in driving the cleaner wheels 16 in a reverse-drive direction, for transport of the cleaner in a reverse direction within the pool.

A timer cam 146 is operated by the gear train 72 for providing a mechanical output to periodically shifting the planetary gear case 126 in an outboard direction, for reverse drive operation. More specifically, as shown in FIGS. 11, 15 and 16, one of the reduction gears referred to by the reference numeral 76" is connected back to and rotatably drives a worm gear 148 within the case 54 of the drive train subassembly 40. This worm gear 148 in turn rotates a gear 150 on a cam shaft 152 rotatably carried by and extending transversely across the case 54. The opposite ends of the cam shaft 152 carry a pair of timer cams 146 including radially outwardly projecting cam lobes 154. The cam lobes 154 are positioned to periodically engage a ramped upper edge of a cam plate 156 mounted onto the side of the case 54 by a pivot 158 to provide shifting of a lower edge of the cam plate in an outboard direction as viewed in FIG. 16. The positions of the cam lobes 154 on the timer cams 146, and the arcuate spans of the cam lobes 154, are chosen to shift the upper edge of the associated cam plate 156 in an inboard direction, resulting in corresponding outboard shifting of the cam plate lower edge to shift the adjacent planetary gear case 126 of the reverse clutch assembly 98 in an outboard direction for reverse drive operation for a predetermined brief time interval on a periodic basis. If desired, the timer cams 146 may be enclosed or substantially enclosed within the case 54 or a suitable cowling (not shown) mounted thereon.

Importantly, the timer cams 146 at the opposite sides of the gear train can be set for concurrent operation to drive the cleaner in a relatively straight reverse path, or the timer cams 146 can be set to provide a sequence of left, right and/or concurrent reverse drive of the wheels at opposite sides of the pool cleaner to drive the cleaner in a nonlinear reverse path. Alternately, is some cases, it may be appropriate or sufficient to drive the cleaner wheels in reverse at only one side of the cleaner, whereby the reverse mode results in a turning movement of the pool cleaner. Subsequent disengagement of the timer cam or cams 146 from the associated cam plates 156 enables the clutch assembly springs 136 (FIGS. 17–18) to return the cleaner to forward-drive operation. This provision of periodic reverse-drive operation can be significant in certain pools wherein the cleaner would otherwise exhibit a tendency to become entrapped with sharp or narrow corners, or other irregular shaped surfaces in a swimming pool of custom design.

One of the timer cams 146 may also be used to open a bypass vent 258 at the top of the turbine chamber 52 during reverse drive operation, to substantially relieve the vacuum at the inlet nozzle 50. As shown in FIGS. 11–12 and 14, the bypass vent 258 is formed at the top of the turbine chamber 52, and a bypass door 160 is pivotally mounted on the case 54 by means of a spring loaded hinge 162 for normally closing the vent 258. One edge of the bypass door 160 includes an actuator arm 164 projecting into close association with the adjacent timer cam 146, so that a cam lobe 154 can engage the actuator arm to pivot the door 160 to an open position at the same time that the cleaner is driven in a reverse direction. When the bypass vent 258 is open, the vacuum hose 14 draws water into the turbine chamber 52 through both the inlet nozzle 50 and the vent 258, thereby substantially diminishing the vacuum at the nozzle 50. Such relieving of the vacuum assists in releasing the pool cleaner from the underlying pool surface during the back-up mode, to achieve a more effective and substantial reverse displacement of the cleaner. In some cases, it may be desirable to design the timer cams 146 to open the bypass door on a periodic basis during forward drive operation, or to time bypass door opening to bridge the transition between forward drive and reverse drive operation.

The improved suction powered pool cleaner of the present invention thus provides efficient vacuum cleaning of debris settled onto submerged floor and wall surfaces of a swimming pool, in response to connection of the pool cleaner to a negative pressure source for vacuuming water through the cleaner. The vacuum water flow additionally drives a turbine of improved design and efficiency for driving the cleaner wheels, and for operating a downforce fan utilized to achieve significantly improved wheel traction. Moreover, the turbine operates one or more timer cams for actuating one or more reverse clutch assemblies in a controlled manner to operate the cleaner in a reverse drive mode at periodic intervals.

A variety of further modifications and improvements in and to the suction powered pool cleaner of the present invention will be apparent to those skilled in the art. Accordingly, no limitation on the invention is intended by way of the foregoing description and accompanying drawings, except as set forth in the appended claims.

What is claimed is:

1. A pool cleaner for connection to a suction source, said pool cleaner comprising:

a cleaner housing supported by a plurality of wheels for rolling movement over submerged surfaces in a swimming pool;

means defining a turbine chamber within said housing, a debris inlet nozzle for vacuum-drawn flow of water and debris generally circumferentially into the turbine chamber, and a suction outlet fitting for connecting the turbine chamber to the suction source;

a turbine including first and second axial ends rotatably supported within the turbine chamber and adapted to be rotatably driven by vacuum-drawn flow of water from said inlet nozzle and through the turbine chamber for flow through said outlet fitting to the suction source, said inlet nozzle being located within a wall of said housing adjacent said turbine chamber axially between the turbine ends, such that said inlet nozzle defines a flow axis which is transverse with respect to the axis of rotation of the turbine, said turbine chamber including a plenum zone exposed to substantially one axial face of said turbine, said plenum zone being interposed between said turbine and said suction outlet fitting; and drive train means coupled between said turbine and at least one of said wheels for rotatably transporting said cleaner housing in a normal forward direction.

2. The pool cleaner of claim 1 wherein said turbine is disposed within the turbine chamber for rotation on an axis extending generally in said normal forward direction of travel.

3. The pool cleaner of claim 1 wherein said debris inlet nozzle is carried by said cleaner housing at a bottom side thereof in relatively close proximity with a submerged pool surface for vacuuming debris settled thereon.

4. The pool cleaner of claim 3 wherein said debris inlet nozzle is formed in an access plate removably mounted to said cleaner housing to permit access to the turbine chamber.

5. The pool cleaner of claim 4 wherein a lower face of said access plate intersects said debris inlet nozzle substantially at a right angle and at a relatively sharp edge.

6. The pool cleaner of claim 3 further including means defining recessed flow channels radiating outwardly from said inlet nozzle at the exterior of said cleaner housing.

7. The pool cleaner of claim 6 further including spacer means for maintaining said inlet nozzle in at least slightly spaced relation with a submerged pool surface.

8. The pool cleaner of claim 3 further including means defining an auxiliary inlet port for vacuum-drawn inflow of water generally into the turbine chamber.

9. The pool cleaner of claim 1 wherein said suction outlet fitting is positioned for vacuum-drawn flow of water and debris axially from said turbine.

10. The pool cleaner of claim 9 wherein said outlet fitting is positioned for vacuum-drawn flow of water and debris axially rearwardly from said turbine.

11. The pool cleaner of claim 1 further including a downforce fan coupled by said drive train means for rotatable driving by said turbine to produce an upwardly directed water flow resulting in a downwardly directed reaction force applied to said cleaner housing.

12. The pool cleaner of claim 11 wherein said downforce fan is rotatably mounted within said cleaner housing, said cleaner housing defining at least one intake vent for inflow of water to said downforce fan, and at least one upwardly open discharge vent for discharge flow of water generally upwardly from said downforce fan.

13. The pool cleaner of claim 12 wherein said at least one intake vent comprises a laterally open intake vent.

14. The pool cleaner of claim 1 wherein said turbine includes a plurality of backward curved turbine blades.

15. The pool cleaner of claim 1 wherein said turbine comprises a twin-bladed impeller.

16. The pool cleaner of claim 15 wherein said twin-bladed impeller includes a pair of backward curved blades.

17. The pool cleaner of claim 1 wherein said plurality of wheels comprises a pair of wheels mounted at one side of said cleaner housing, and a single wheel mounted at an opposite side of said cleaner housing.

18. The pool cleaner of claim 1 wherein said cleaner housing defines a front nose oriented at an angle relative to said normal forward direction of travel.

19. The pool cleaner of claim 1 further including reverse drive means actuatable for coupling said at least one of said wheels to said drive train means for transporting said cleaner housing in a reverse drive direction, and timer means driven by said turbine for periodically actuating said reverse drive means.

20. The pool cleaner of claim 19 wherein said reverse drive means comprises a reverse clutch assembly coupled between said at least one of said wheels and said drive train means.

21. The pool cleaner of claim 19 wherein said timer means comprises a timer cam driven by said drive train means.

22. The pool cleaner of claim 19 wherein said reverse drive means comprises a pair of reverse clutch assemblies coupled between said drive train means and at least one of said wheels respectively on opposite sides of said cleaner housing.

23. The pool cleaner of claim 22 wherein said timer means comprises a pair of timer cams driven by said drive train means for separately actuating said pair of reverse clutch assemblies.

24. The pool cleaner of claim 19 further including means for relieving the vacuum at said debris inlet nozzle.

25. The pool cleaner of claim 24 wherein said vacuum relieving means comprises means defining a bypass vent opening into the turbine chamber, and a normally closed bypass door for closing said bypass vent, said bypass door being engaged and opened by said timer means.

26. A pool cleaner for connection to a suction source, said pool cleaner comprising:

a cleaner housing supported by a plurality of wheels for rolling movement over submerged surfaces in a swimming pool;

means defining a turbine chamber within said housing, a debris inlet nozzle for vacuum-drawn flow of water and debris into the turbine chamber, and a suction outlet fitting for connecting the turbine chamber to the suction source;

a turbine rotatably supported within the turbine chamber and adapted to be rotatably driven by vacuum-drawn flow of water from said inlet nozzle and through the turbine chamber for flow through said outlet fitting to the suction source;

drive train means coupled between said turbine and at least one of said wheels for rotatably transporting said cleaner housing in a normal forward direction; and a downforce fan coupled by said drive train means for rotatable driving by said turbine to produce an upwardly directed water flow resulting in a downwardly directed reaction force applied to said cleaner housing.

27. The pool cleaner of claim 26 wherein said downforce fan is rotatably mounted within said cleaner housing, said cleaner housing defining at least one intake vent for inflow of water to said downforce fan, and at least one upwardly open discharge vent for discharge flow of water generally upwardly from said downforce fan.

28. The pool cleaner of claim 27 wherein said at least one intake vent comprises a laterally open intake vent.

29. The pool cleaner of claim 26 wherein said turbine includes a plurality of backward curved turbine blades.

30. The pool cleaner of claim 29 wherein said turbine comprises a twin-bladed impeller.

31. The pool cleaner of claim 26 wherein said turbine is disposed within the turbine chamber for rotation on an axis extending generally in said normal forward direction of travel.

32. The pool cleaner of claim 26 wherein said debris inlet nozzle is carried by said cleaner housing at a bottom side thereof in relatively close proximity with a submerged pool surface for vacuuming debris settled thereon.

33. The pool cleaner of claim 32 wherein said debris inlet nozzle is formed in an access plate removably mounted to said cleaner housing to permit access to the turbine chamber.

34. The pool cleaner of claim 33 further including means defining recessed flow channels radiating outwardly from said inlet nozzle at the exterior of said cleaner housing.

35. The pool cleaner of claim 34 further including spacer means for maintaining said inlet nozzle in at least slightly spaced relation with a submerged pool surface.

36. The pool cleaner of claim 33 further including means defining an auxiliary inlet port for vacuum-drawn inflow of water into the turbine chamber.

37. The pool cleaner of claim 32 wherein said inlet nozzle is oriented for vacuum-drawn inflow of water generally circumferentially into the turbine chamber for rotatably driving said turbine.

38. The pool cleaner of claim 37 wherein said suction outlet fitting is positioned for vacuum-drawn flow of water and debris axially from said turbine, and wherein the turbine chamber includes a plenum zone exposed to substantially one axial face of said turbine, said plenum zone being interposed between said turbine and said suction outlet fitting.

39. The pool cleaner of claim 26 wherein said plurality of wheels comprises a pair of wheels mounted at one side of said cleaner housing, and a single wheel mounted at an opposite side of said cleaner housing.

40. The pool cleaner of claim 26 wherein said cleaner housing defines a front nose oriented at an angle relative to said normal forward direction of travel.

41. The pool cleaner of claim 26 further including reverse drive means actuatable for coupling said at least one of said wheels to said drive train means for transporting said cleaner housing in a reverse drive direction, and timer means driven by said turbine for periodically actuating said reverse drive means.

42. The pool cleaner of claim 41 further including means for relieving the vacuum at said debris inlet nozzle.

43. A pool cleaner for connection to a suction source, said pool cleaner comprising:

a cleaner housing supported by a plurality of wheels for rolling movement over submerged surfaces in a swimming pool;

means defining a turbine chamber within said housing, a debris inlet nozzle for vacuum-drawn flow of water and debris into the turbine chamber, and a suction outlet fitting for connecting the turbine chamber to the suction source;

a turbine rotatably supported within the turbine chamber and adapted to be rotatably driven by vacuum-drawn flow of water from said inlet nozzle and through the turbine chamber for flow through said outlet fitting to the suction source;

drive train means coupled between said turbine and at least one of said wheels for rotatably transporting said cleaner housing in a normal forward direction;

reverse drive means actuatable for coupling said at least one of said wheels to said drive train means for driving said at least one of said wheels in a reverse drive direction, said reverse drive means comprising a pair of reverse clutch assemblies coupled between said drive train means and at least one of said wheels respectively on opposite sides of said cleaner housing; and timer means driven by said turbine for periodically actuating said reverse drive means.

44. The pool cleaner of claim 43 wherein said timer means comprises a timer cam driven by said drive train means.

45. The pool cleaner of claim 43 wherein said timer means comprises a pair of timer cams driven by said drive train means for separately actuating said pair of reverse clutch assemblies.

46. The pool cleaner of claim 43 wherein said inlet nozzle is oriented for vacuum-drawn inflow of water generally circumferentially into the turbine chamber for rotatably driving said turbine.

47. The pool cleaner of claim 46 wherein the turbine chamber includes a plenum zone exposed to substantially one axial face of said turbine, said plenum zone being interposed between said turbine and said suction outlet fitting.

48. A pool cleaner for connection to a suction source, said pool cleaner comprising:

a cleaner housing supported by a plurality of wheels for rolling movement over submerged surfaces in a swimming pool;

means defining a turbine chamber within said housing, a debris inlet nozzle for vacuum-drawn flow of water and debris into the turbine chamber, and a suction outlet fitting for connecting the turbine chamber to the suction source;

a turbine rotatably supported within the turbine chamber and adapted to be rotatably driven by vacuum-drawn flow of water from said inlet nozzle and through the turbine chamber for flow through said outlet fitting to the suction source;

drive train means coupled between said turbine and at least one of said wheels for rotatably transporting said cleaner housing in a normal forward direction;

reverse drive means actuatable for coupling said at least one of said wheels to said drive train means for driving said at least one of said wheels in a reverse drive direction;

timer means driven by said turbine for periodically actuating said reverse drive means; and means for relieving the vacuum at said debris inlet nozzle, said vacuum relieving means comprising means defining a bypass vent opening into the turbine chamber, and a normally closed bypass door for closing said bypass vent, said bypass door being engaged and opened by said timer means.

49. A pool cleaner for connection to a suction source, said pool cleaner comprising:

a cleaner housing supported by a plurality of wheels for rolling movement over submerged surfaces in a swimming pool;

means defining a turbine chamber within said housing, a debris inlet nozzle for vacuum-drawn flow of water and debris into the turbine chamber, and a suction outlet fitting for connecting the turbine chamber to the suction source;

a turbine rotatably supported within the turbine chamber and adapted to be rotatably driven by vacuum-drawn flow of water from said inlet nozzle and through the turbine chamber for flow through said outlet fitting to the suction source;

drive train means coupled between said turbine and at least one of said wheels for rotatably transporting said cleaner housing in a normal forward direction;

reverse drive means actuatable for coupling said at least one of said wheels to said drive train means for driving said at least one of said wheels in a reverse drive direction;

timer means driven by said turbine for periodically actuating said reverse drive means; and a downforce fan coupled by said drive train means for rotatable driving by said turbine to produce an upwardly directed water flow resulting in a downwardly directed reaction force applied to said cleaner housing.

50. The pool cleaner of claim 49 wherein said downforce fan is rotatably mounted within said cleaner housing, said cleaner housing defining at least one intake vent for inflow of water to said downforce fan, and at least one upwardly open discharge vent for discharge flow of water generally upwardly from said downforce fan.

51. A pool cleaner for connection to a suction source, said pool cleaner comprising:

a cleaner housing supported by a plurality of wheels for rolling movement over submerged surfaces in a swimming pool;

means defining a turbine chamber within said housing, a debris inlet nozzle for vacuum-drawn flow of water and debris into the turbine chamber, and a suction outlet fitting for connecting the turbine chamber to the suction source;

a turbine rotatably supported within the turbine chamber and adapted to be rotatably driven by vacuum-drawn flow of water from said inlet nozzle and through the turbine chamber for flow through said outlet fitting to the suction source;

drive train means coupled between said turbine and at least one of said wheels for rotatably transporting said cleaner housing in a normal forward direction;

reverse drive means actuatable for coupling said at least one of said wheels to said drive train means for driving said at least one of said wheels in a reverse drive direction; and timer means driven by said turbine for periodically actuating said reverse drive means;

said turbine being disposed within the turbine chamber for rotation on an axis extending generally in said normal forward direction of travel.

52. A pool cleaner for connection to a suction source, said pool cleaner comprising:

a cleaner housing supported by a plurality of wheels for rolling movement over submerged surfaces in a swimming pool;

means defining a turbine chamber within said housing, a debris inlet nozzle for vacuum-drawn flow of water and debris into the turbine chamber, and a suction outlet fitting for connecting the turbine chamber to the suction source;

a turbine rotatably supported within the turbine chamber and adapted to be rotatably driven by vacuum-drawn flow of water from said inlet nozzle and through the turbine chamber for flow through said outlet fitting to the suction source;

drive train means coupled between said turbine and at least one of said wheels for rotatably transporting said cleaner housing in a normal forward direction;

a downforce fan coupled by said drive train means for rotatable driving by said turbine to produce an upwardly directed water flow resulting in a downwardly directed reaction force applied to said cleaner housing;

reverse drive means actuatable for coupling said at least one of said wheels to said drive train means for driving said at least one of said cleaner wheels in a reverse drive direction; and timer means driven by said turbine for periodically actuating said reverse drive means;

said turbine being disposed within the turbine chamber for rotation on an axis extending generally in said normal forward direction of travel, said inlet nozzle being oriented for vacuum-drawn inflow of water generally circumferentially into the turbine chamber for rotatably driving said turbine, and wherein the turbine chamber includes a plenum zone exposed to substantially one axial face of said turbine, said plenum zone being interposed between said turbine and said suction outlet fitting.

53. The pool cleaner of claim 52 wherein said reverse drive means comprises a reverse clutch assembly coupled between said at least one of said wheels and said drive train means.

54. The pool cleaner of claim 52 wherein said timer means comprises a timer cam driven by said drive train means.

55. The pool cleaner of claim 52 wherein said reverse drive means comprises a pair of reverse clutch assemblies coupled between said drive train means and at least one of said wheels respectively on opposite side of said cleaner housing.

56. The pool cleaner of claim 55 wherein said timer means comprises a pair of timer cams driven by said drive train means for separately actuating said pair of reverse clutch assemblies.

57. The pool cleaner of claim 52 further including means for relieving the vacuum at said debris inlet nozzle.

58. The pool cleaner of claim 57 wherein said vacuum relieving means comprises means defining a bypass vent opening into the turbine chamber, and a normally closed bypass door for closing said bypass vent, said bypass door being engaged and opened by said timer means.

59. The pool cleaner of claim 52 wherein said downforce fan is rotatably mounted within said cleaner housing, said cleaner housing defining at least one intake vent for inflow of water to said downforce fan, and at least one upwardly open discharge vent for discharge flow of water generally upwardly from said downforce fan.

* * * * *